US010877401B2

(12) United States Patent
Ariizumi et al.

(10) Patent No.: US 10,877,401 B2
(45) Date of Patent: Dec. 29, 2020

(54) FEEDING SCREW AND DEVELOPING DEVICE

(71) Applicant: CANON KABUSHIKI KAISHA, Tokyo (JP)

(72) Inventors: Osamu Ariizumi, Matsudo (JP); Shunsuke Tsuda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/562,737

(22) Filed: Sep. 6, 2019

(65) Prior Publication Data

US 2019/0391511 A1 Dec. 26, 2019

Related U.S. Application Data

(63) Continuation of application No. 15/982,053, filed on May 17, 2018, now abandoned.

(30) Foreign Application Priority Data

May 22, 2017 (JP) ..... 2017-100862

(51) Int. Cl.
*G03G 15/08* (2006.01)

(52) U.S. Cl.
CPC ..... *G03G 15/0891* (2013.01); *G03G 15/0877* (2013.01); *G03G 15/0889* (2013.01);
(Continued)

(58) Field of Classification Search
CPC ..... G03G 15/0891; G03G 15/0893; G03G 15/0877; G03G 2215/083;
(Continued)

(56) References Cited

U.S. PATENT DOCUMENTS 8,971,770 B2 3/2015 Nakajima et al.
2011/0008068 A1* 1/2011 Kunihiro ..... G03G 15/0844 399/92

(Continued)

FOREIGN PATENT DOCUMENTS

EP 1 887 438 A1 2/2008
JP H06-51633 A 2/1994

(Continued)

OTHER PUBLICATIONS

European Search Report dated Nov. 15, 2018, in related European Patent Application No. 18171994.9.

(Continued)

*Primary Examiner* — Walter L Lindsay, Jr.
*Assistant Examiner* — Laura Roth
(74) *Attorney, Agent, or Firm* — Venable LLP

(57) ABSTRACT

A feeding screw for feeding a developer includes a rotation shaft, a first blade portion helically formed on an outer peripheral surface of the rotation shaft to feed the developer in one direction, a second blade portion helically formed on the outer peripheral surface to feed the developer in the one direction, and a third blade portion helically formed on the outer peripheral surface to feed the developer in the one direction. The first blade portion and the second blade portion overlap with each other with respect to a rotational axis direction of the feeding screw, the second blade portion and the third blade portion do not overlap with each other with respect to the rotational axis direction, and the third blade portion and the first blade portion overlap with each other with respect to the rotational axis direction.

15 Claims, 11 Drawing Sheets

(52) U.S. Cl.
CPC ... *G03G 15/0893* (2013.01); *G03G 2215/083* (2013.01); *G03G 2215/0819* (2013.01); *G03G 2215/0822* (2013.01); *G03G 2215/0827* (2013.01)

(58) Field of Classification Search
CPC ... G03G 2215/0827; G03G 2215/0822; G03G 15/0865; G03G 15/0808; G03G 15/163; G03G 2221/1657; G03G 21/1647; G03G 15/0887; G03G 15/0889; G03G 2215/0819; G03G 2215/0838; G03G 15/0812
See application file for complete search history.

(56) References Cited

U.S. PATENT DOCUMENTS

| | | | | |
|---|---|---|---|---|
| 2011/0222913 | A1 | 9/2011 | Sasaki et al. | |
| 2014/0193176 | A1 | 7/2014 | Nakajima et al. | |
| 2014/0301747 | A1* | 10/2014 | Takahashi | G03G 15/0921 399/30 |
| 2017/0255129 | A1 | 9/2017 | Suzuki | |
| 2017/0269505 | A1 | 9/2017 | Ariizumi et al. | |
| 2017/0308005 | A1 | 10/2017 | Ariizumi | |
| 2017/0329258 | A1 | 11/2017 | Tsuda | |
| 2018/0017895 | A1 | 1/2018 | Ariizumi | |
| 2018/0039203 | A1 | 2/2018 | Ahne et al. | |
| 2018/0253033 | A1 | 9/2018 | Fujishima | |
| 2018/0335722 | A1 | 11/2018 | Ariizumi et al. | |
| 2018/0335723 | A1 | 11/2018 | Ariizumi et al. | |
| 2018/0335724 | A1* | 11/2018 | Shirayanagi | G03G 15/0877 |

FOREIGN PATENT DOCUMENTS

| | | | | |
|---|---|---|---|---|
| JP | H09-120201 | A | | 5/1997 |
| JP | H09-258535 | A | | 10/1997 |
| JP | 2008-310200 | A | | 12/2008 |
| JP | 2010-256429 | A | | 11/2010 |
| JP | 2011-064766 | A | | 3/2011 |
| JP | 2011064766 | A | * | 3/2011 |
| JP | 2014-134619 | A | | 7/2014 |

OTHER PUBLICATIONS

European Office Action dated Nov. 19, 2019, in related European Patent Application No. 18171994.9.

European Office Action dated Sep. 3, 2020, in related European Patent Application No. 18171994.9.

Anonymous: "Lead (engineering)—Wikipedia", May 1, 2018, XP055726313, Retrieved from the Internet: URL:https://en.wikipedia.org/w/index.php?title=Lead_(engineering)&oldid=839142719 [retrieved on Aug. 31, 2020].

* cited by examiner (a)

(b)

| NOT*1 | PCV*2⊿(%) | IDN*3 | SOPL*4 (mm) | SDC*5 |
|---|---|---|---|---|
| 2(1:1) | 0.9 | △ | 79 | 1.81 |
| 2(1.5:1) | 0.95 | △ | 85 | 1.93 |
| 2(2:1) | 1 | ○ | 88 | 2 |
| 2(4:1) | 1.15 | ○ | 106 | 2.42 |
| | | | | |
| 3(0.25:1) | 1.25 | ○ | 117 | 2.66 |
| 3(1:1) | 1.3 | ○ | 133 | 3.02 |
| 3(4:1) | 1.2 | ○ | 149 | 3.38 |
| | | | | |
| 4(1:1) | 0.8 | △ | 188 | 4.23 |
| 4(4:1) | 0.6 | △ | 202 | 4.6 |

*1 : " NOT " IS THE NUMBER OF THREADS(BLADE:GAP PORTION).

*2 : " PCV " IS A PEAK CHANGE VALUE⊿(%).

*3 : " IDN " IS IMAGE DENSITY NON-UNIFORMITY.

*4 : " SOPL " IS A SUM OF SCREW OUTER PELIPHERAL LENGTHS (mm).

*5 : " SDC " IS STIRRING DISTANCE COEFFICIENT.

Fig. 15

FEEDING SCREW AND DEVELOPING DEVICE

This application is a continuation of application Ser. No. 15/982,053, filed May 17, 2018.

FIELD OF THE INVENTION AND RELATED ART

The present invention relates to a feeding screw including blades with a plurality of threads and relates to a developing device including the feeding screw.

In an image forming apparatus using an electrophotographic type, an electrostatic latent image formed on a photosensitive drum is developed as a toner image by a developing device. As the developing device, a developing device using a two-component developer containing toner and a carrier has been conventionally used. In the case of the developing device using the two-component developer, the developer accommodated in a developing container is fed by a screw while being stirred by the screw.

As the screw for feeding the developer while stirring the developer, a constitution in which a multi-thread screw including a plurality of blades each helically formed with a single thread around a rotation shaft is used has been proposed (Japanese Laid-Open Patent Application (JP-A) Hei 9-258535).

Further, a constitution in which two blades each helically formed with a single thread around a rotation shaft are provided and each of the two blades (two threads) is discontinuous in an axial direction of the rotation shaft has been proposed (JP-A 2010-256429).

As described in JP-A Hei 9-258535, in the case where the multi-thread screw is simply used as the screw for feeding the developer, there is a possibility that a stirring property of the developer cannot be sufficiently ensured. That is, by using the multi-thread screw, a feeding property of the developer can be enhanced, but correspondingly, the developer stirring property lowers.

On the other hand, as disclosed in JP-A 2010-256429, in the case where each of the two blades (two threads) is provided with the discontinuous portion, there is a possibility that the feeding property of the developer cannot be sufficiently ensured. That is, when the blade includes the discontinuous portion, an area of the blade contributing to feeding of the developer decreases, and therefore, the feeding property of the developer lowers. In the case of the constitution disclosed in JP-A 2010-256429, each of the blades similarly lowers in developer feeding property, and therefore, there is a possibility that the developer feeding property of the screw cannot be sufficiently ensured.

SUMMARY OF THE INVENTION

A principal object of the present invention is to provide a feeding screw and a developing device which are capable of compatibly realizing ensuring of a developer feeding property and a developer stirring property.

According to an aspect of the present invention, there is provided a feeding screw comprising: a rotation shaft; and a plurality of blades helically formed with threads on the rotation shaft, wherein the feeding screw includes a section in which a helix angle of each of the blades is not more than 56.5°.

Further features of the present invention will become apparent from the following description of exemplary embodiments with reference to the attached drawings.

Figure 12:
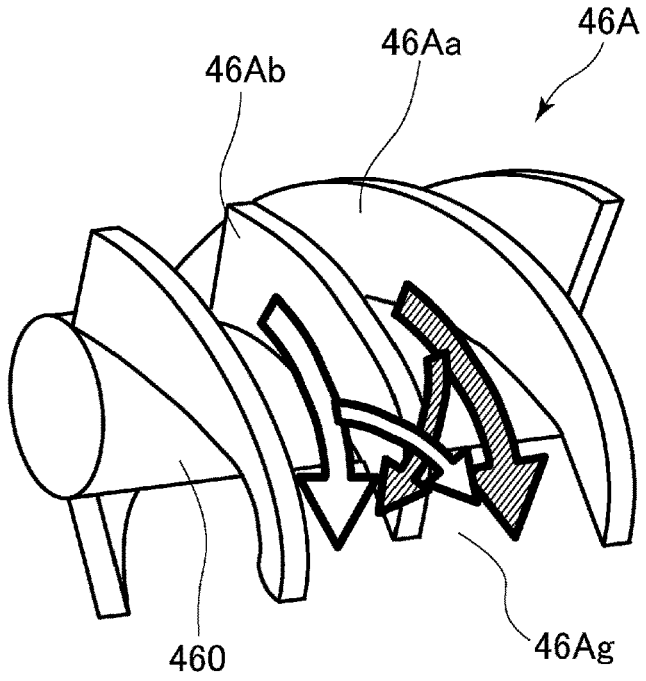
Figure 12:
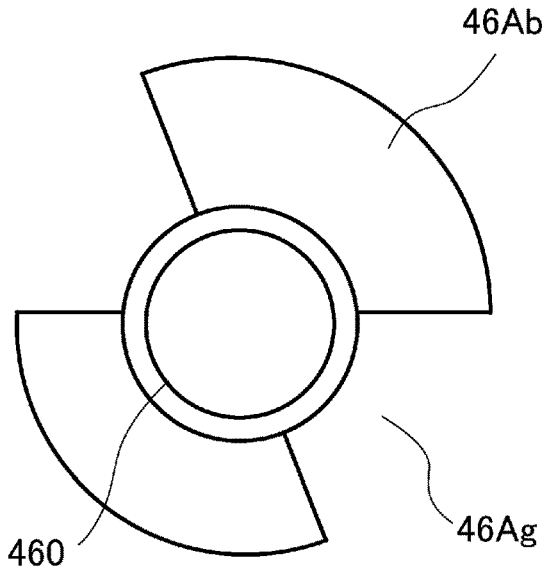

Part (a) of FIG. 12 is a perspective view showing a part of a second screw according to a Second Embodiment, and part (b) of FIG. 12 is a schematic view of a blade provided with a gap portion as seen in an axial direction.

Figure 13:
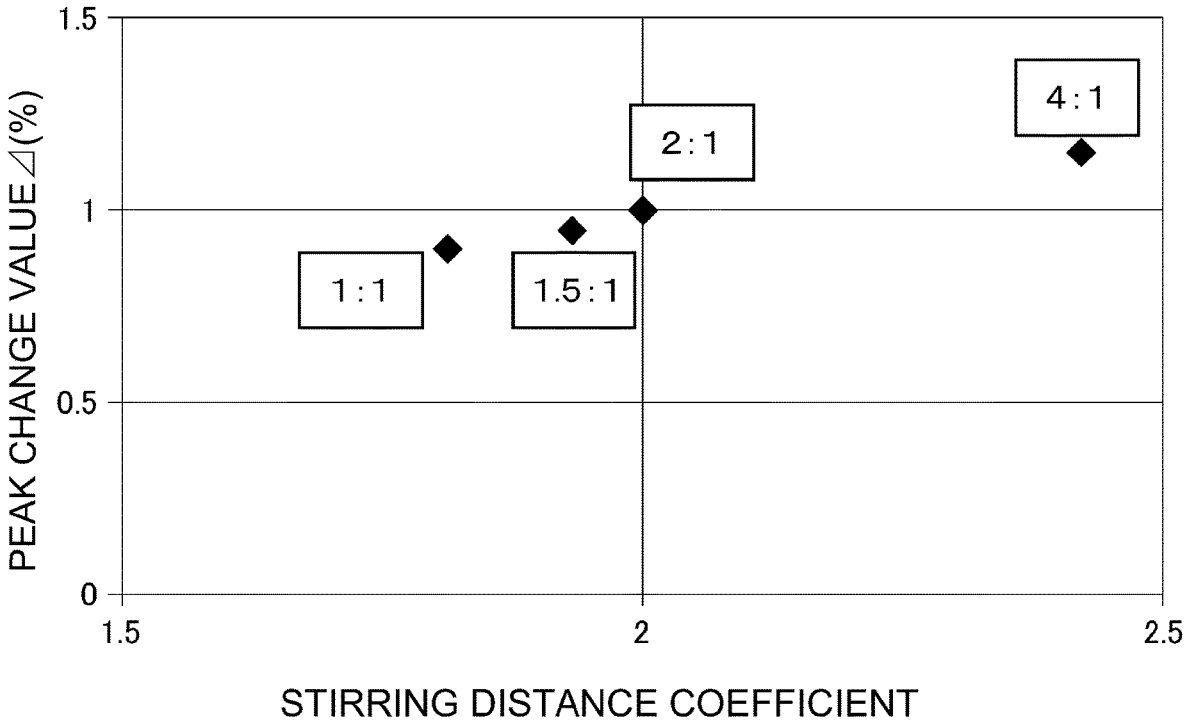

FIG. 13 is a graph showing a relationship between stirring distance coefficient and a peak change value.

Figure 14:
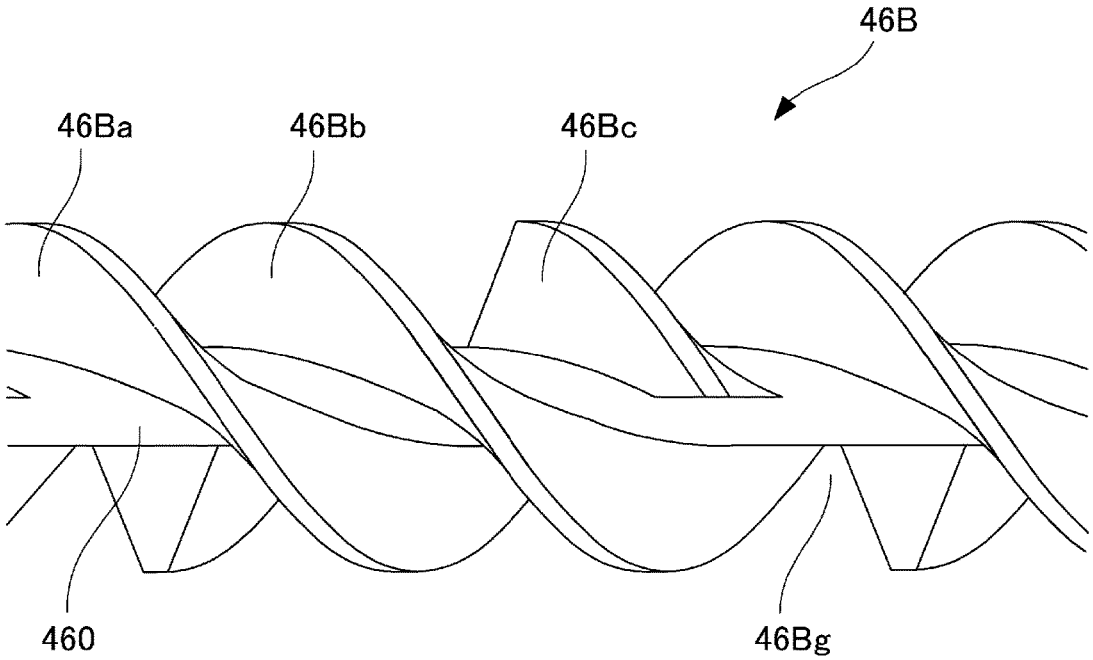

FIG. 14 is a perspective view showing a part of a second screw according to a Third Embodiment.

FIG. 15 is a table showing a result of calculation of a peak change value and image density non-uniformity in respective screws.

Figure 16:
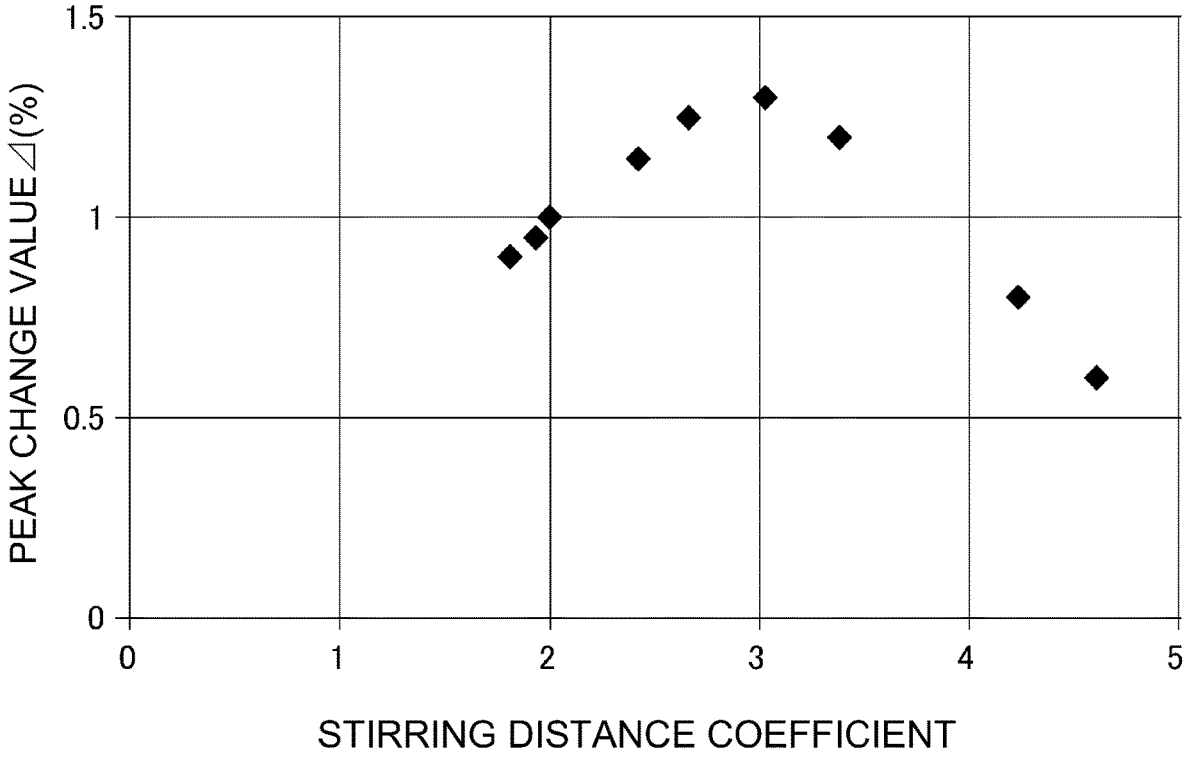

FIG. 16 is a graph showing a relationship between stirring distance coefficient and the peak change value.

DESCRIPTION OF EMBODIMENTS

First Embodiment

A First Embodiment will be described with reference to FIGS. 1 to 12. First, a general structure of an image forming apparatus in this embodiment will be described using FIG. 1.

[Image Forming Apparatus]

An image forming apparatus 100 is an electrophotographic full-color printer including four image forming portions PY, PM, PC and PK provided corresponding to four colors of yellow, magenta, cyan and black, respectively. In this embodiment, the image forming apparatus 100 is of a tandem type in which the image forming portions PY, PM, PC and PK are disposed along a rotational direction of an intermediary transfer belt 10 described later. The image forming apparatus 100 forms a toner image (image) on a recording material P depending on an image signal from a host device such as an original reader (not shown) communicatably connected with an image forming apparatus main assembly or a personal computer communicatably connected with the image forming apparatus main assembly. As the recording material P, it is possible to cite sheet materials such as a sheet, a plastic film and a cloth.

An outline of such an image forming process will be described. First, in the respective image forming portions PY, PM, PC and PK, toner images of the respective colors are formed on photosensitive drums 1Y, 1M, 1C and 1K, respectively. The thus formed color toner images are transferred onto the intermediary transfer belt 10 and then are transferred from the intermediary transfer belt 10 onto the recording material P. The recording material P on which the toner images are transferred is fed to a fixing device 11, in which the toner images are fixed on the recording material P. This will be described specifically below.

The four image forming portions PY, PM, PC and PK provided in the image forming apparatus 100 have substantially the same except that colors of developers are different from each other. Accordingly, in the following, as a representative, the image forming portion PY will be described, and constituent elements of other image forming portions are represented by replacing a suffix "Y", added to reference numerals or symbols of these in the image forming portion PY, with "M", "C" and "K", respectively, and will be omitted from description.

In the image forming portion PY, as an image bearing member, a cylindrical photosensitive member, i.e., the photosensitive drum 1Y, is provided. The photosensitive drum 1Y, for example, 30 mm in diameter, 360 mm in length with respect to a longitudinal direction (rotational axis direction) and 250 mm/sec in process speed (peripheral speed), and is rotationally driven in an arrow direction in FIG. 1. At a periphery of the photosensitive drum 1Y, a charging roller 2Y (charging device), a developing device 4Y, a primary transfer roller 5Y and a cleaning device 6Y are provided. Below the photosensitive drum 1Y in the figure, an exposure device (laser scanner) 3Y is provided.

The charging roller 2Y is, for example, 14 mm in diameter and 320 mm in length with respect to the longitudinal direction and is rotated by the photosensitive drum 1Y during image formation. The charging roller 2Y is urged toward the photosensitive drum 1Y by an urging spring (not shown). Further, to the charging roller 2Y, a charging bias (for example, DC voltage: −900 V, AC peak-to-peak voltage: 1500 V) is applied from a high-voltage source. As a result, the photosensitive drum 1Y is electrically charged substantially uniformly by the charging roller 2Y.

Further, the intermediary transfer belt 10 is disposed opposed to the photosensitive drums 1Y, 1M, 1C and 1K. The intermediary transfer belt 10 is stretched by a plurality of stretching rollers and is circulated and moved in an arrow direction by drive of an inner secondary transfer roller 12 also functioning as a driving roller. At a position opposing the inner secondary transfer roller 12 through the intermediary transfer belt 10, an outer secondary transfer roller 13 as a secondary transfer member 13 is provided, and constitutes a secondary transfer portion T2 where the toner image is transferred from the intermediary transfer belt 10 onto the recording material P. On a side downstream of the secondary transfer portion T2 with respect to a recording material feeding direction, the fixing device 11 is disposed.

A process for forming the image by the image forming apparatus 100 constituted as described above will be described. First, when an image forming operation is started, a surface of the rotating photosensitive drum 1Y is electrically charged uniformly by the charging roller 2. Then, the photosensitive drum 1Y is exposed to laser light emitted from the exposure device 3Y and corresponding to an image signal. As a result, an electrostatic latent image corresponding to the image signal is formed on the photosensitive drum 1Y. The electrostatic latent image on the photosensitive drum 1Y is visualized by the toner accommodated in the developing device 4Y and thus is formed in a visible image (toner image).

The toner image formed on the photosensitive drum 1Y is primary-transferred onto the intermediary transfer belt 10 at a primary transfer portion T1Y constituted between the photosensitive drum 1Y and the intermediary transfer belt 10 sandwiched by the primary transfer roller 5Y and the photosensitive drum 1Y. Toner (transfer residual toner) remaining on the surface of the photosensitive drum 1Y after primary transfer is removed by the cleaning device 6Y.

Such an operation is successively performed also in the respective image forming portions for magenta, cyan and black, so that the resultant four color toner images are superposed on the intermediary transfer belt 10. Thereafter, the recording material P accommodated in a recording material accommodating cassette (not shown) is fed to the secondary transfer portion T2 in synchronism with timing of toner image formation, and the four color toner images are secondary-transferred together from the intermediary transfer belt 10 onto the recording material P. Toner remaining on the intermediary transfer belt 10 which cannot be completely transferred at the secondary transfer portion T2 is removed by an unshown intermediary transfer belt cleaner.

Then, the recording material P is fed to the fixing device 11. The toners (toner images) on the recording material P are melted and mixed under application of heat and pressure, and are fixed as a full-color image on the recording material P. Thereafter, the recording material P is discharged to an outside of the image forming apparatus. As a result, a series of image forming processes is ended. Incidentally, by using only desired image forming portion(s), it is also possible to form an image of a desired signal color or images of desired plurality of colors.

[Developing Device]

Next, the developing device 4Y will be described using FIGS. 2 and 3. Incidentally, also the developing devices 4M, 4C and 4K are similarly constituted. The developing device 4 includes a developing container 41 accommodating a two-component developer containing a non-magnetic toner and a magnetic carrier. The developing container 41 opens at a portion of a developing region opposing the photosensitive drum 1Y, and a developing sleeve 44 as a developer carrying member in which a magnet roller 44*a* is non-rotatably provided is provided so as to be partly exposed at an opening of the developing container 41.

Figure 1:
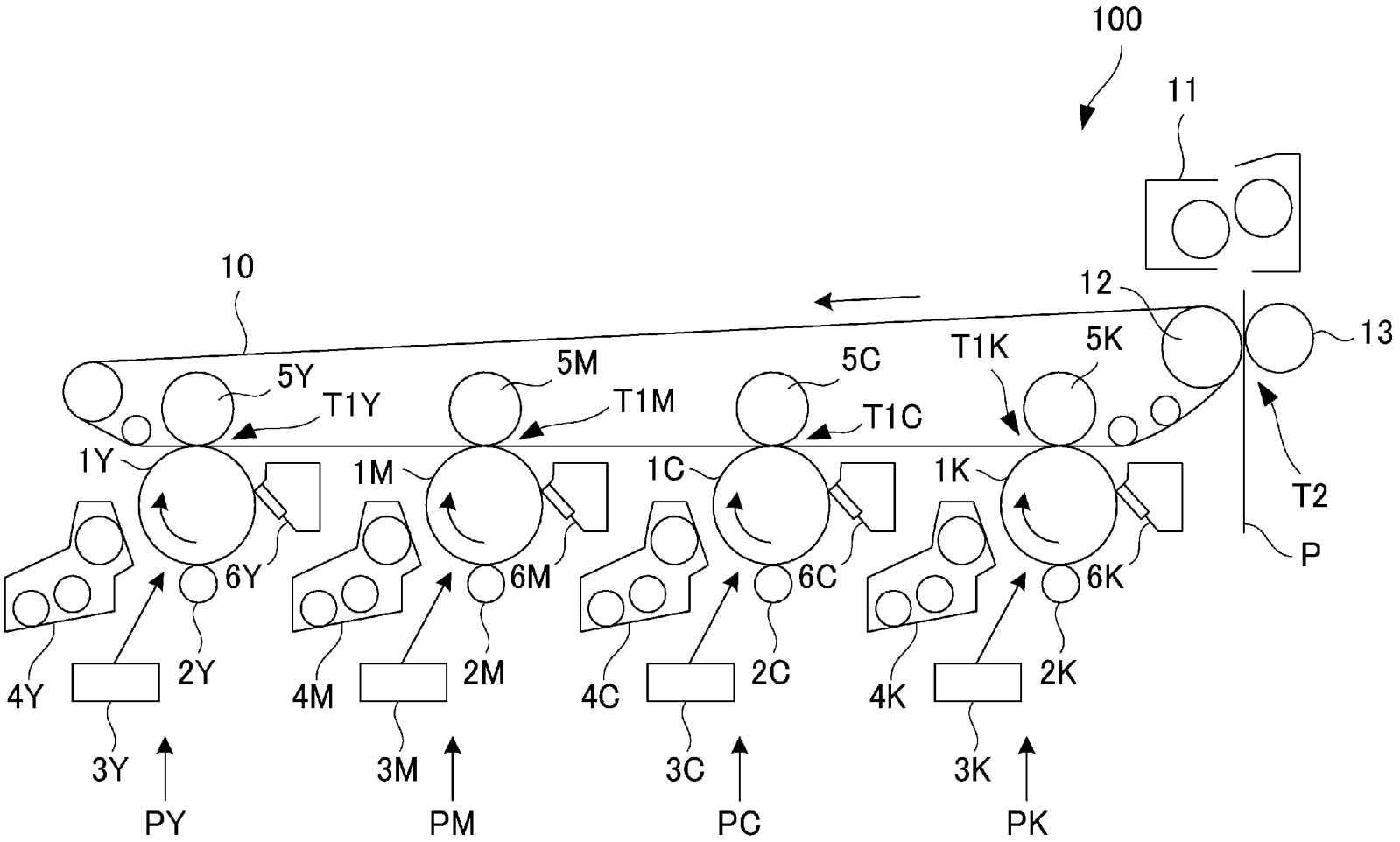
FIG. 1 is a schematic view of an image forming apparatus in a First Embodiment.
Figure 2:
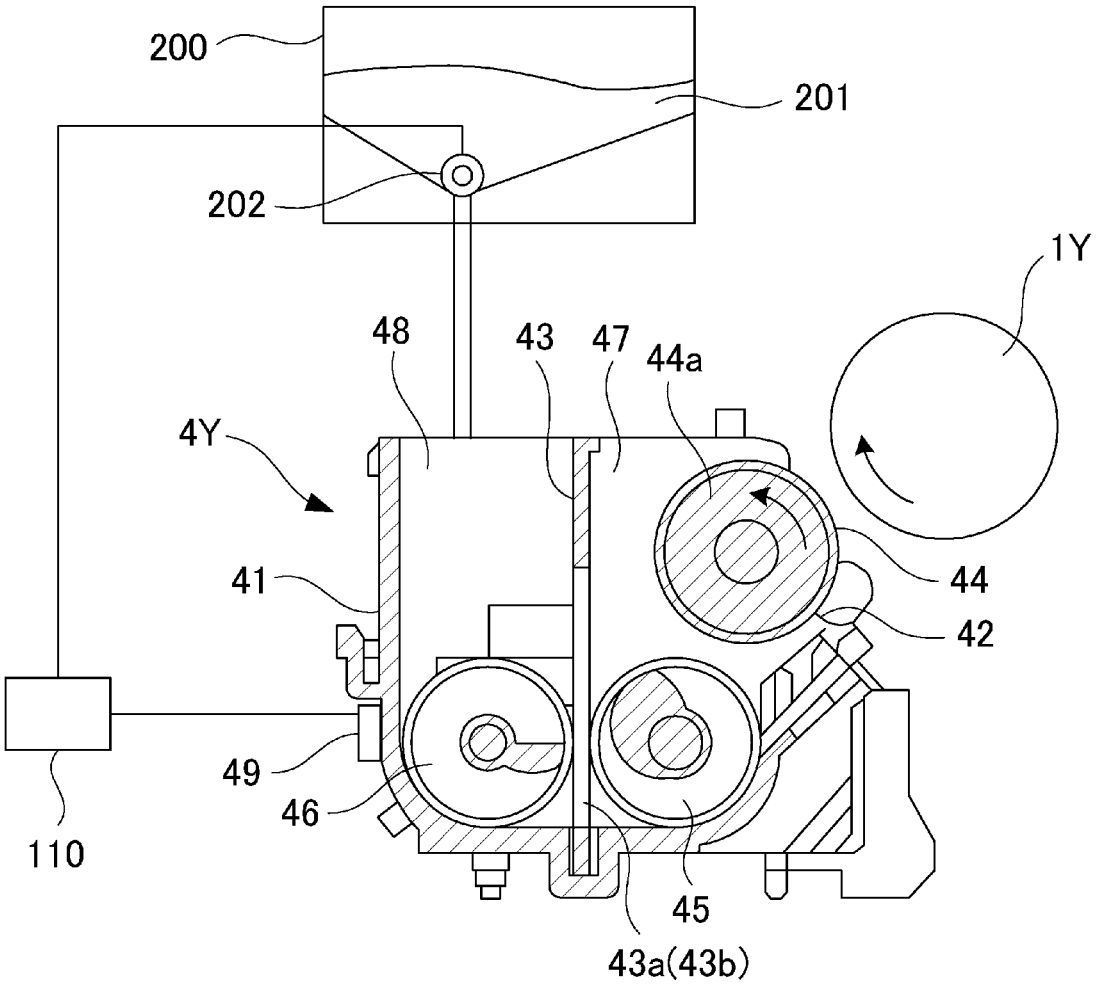
FIG. 2 is a schematic view of a developing device according to the First Embodiment.
Figure 3:
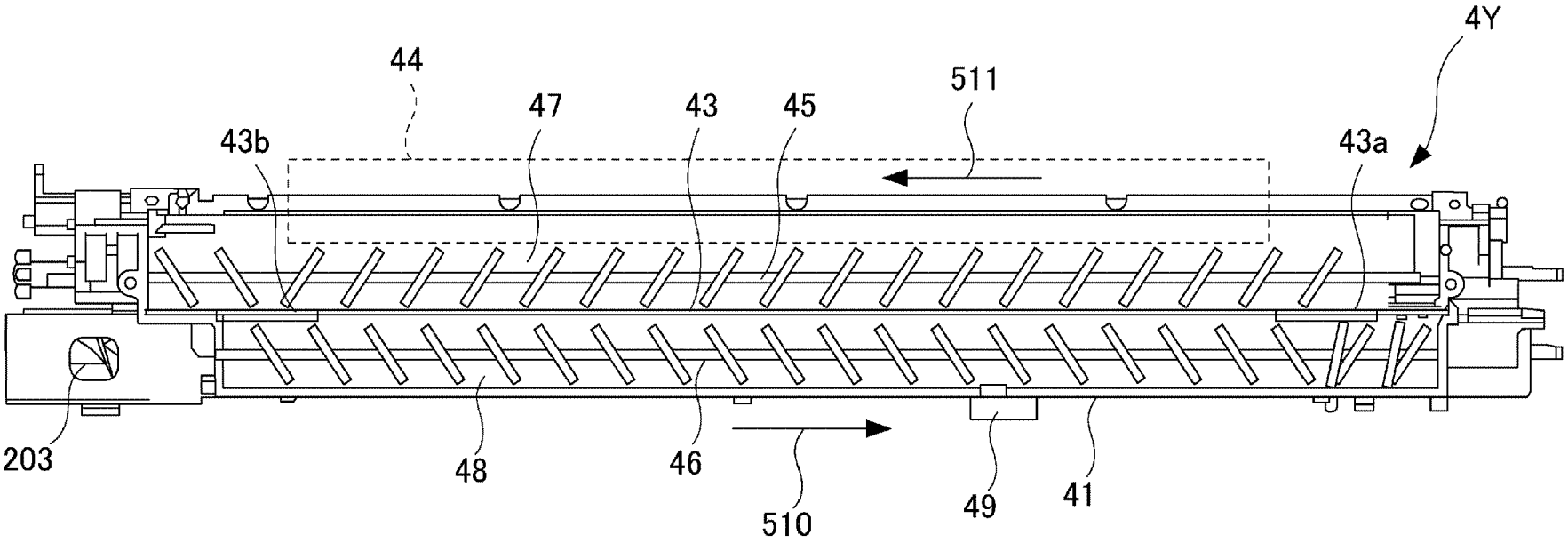
FIG. 3 is a top (plan) view showing the developing device according to the First Embodiment in a partly simplified manner.

In this embodiment, the developing sleeve 44 is constituted by a non-magnetic material, and for example, is 20 mm in diameter and 334 mm in longitudinal length, and is rotated in an arrow direction in FIG. 2 at a process speed (peripheral speed) of 250 mm/sec. The magnet roller 44*a* as a magnetic field generating means includes a plurality of magnetic poles along a circumferential direction, and by a magnetic field generated by the magnetic roller 44*a*, the developer is carried on the surface of the developing sleeve 44.

A layer thickness of the developer carried on the surface of the developing sleeve 44 is regulated by a developing blade 42, so that a thin layer of the developer is formed on the surface of the developing sleeve 44. The developing sleeve 44 feeds the developer formed in the thin layer to the developing region while carrying the developer. In the developing region, the developer on the developing sleeve 44 is erected and forms a magnetic chain. In this embodiment, the magnetic chain is contacted to the photosensitive drum 1Y, and the toner of the developer is supplied to the photosensitive drum 1Y, so that the electrostatic latent image is developed as the toner image. At this time, in order to improve developing efficiency, i.e., a toner imparting ratio to the latent image, to the developing sleeve 44, a developing bias voltage in the form of a DC voltage biased with an AC voltage is applied from a voltage (power) source. The developer after the latent image is developed with the developer is collected in a developing chamber 47, described later, in the developing container 41 with rotation of the developing sleeve 44.

An inside of the developing container 41 is partitioned into the developing chamber 47 as a first chamber and a stirring chamber 48 as a second chamber by a partition wall 43 extending in a vertical direction. On both end sides of the partition wall 43 with respect to a longitudinal direction (rotational axis direction of the developing sleeve 44), communication ports 43*a* and 43*b* for establishing communication between the developing chamber 47 and the stirring chamber 48 are formed. As a result, a developer circulating path is formed by the developing chamber 47 and the stirring chamber 48.

Further, in the developing container 41, a first screw 45 as a first feeding portion for feeding the developer while stirring the developer and a second screw 46 as a second feeding member for feeding the developer while stirring the developer are provided. The first screw 45 is disposed in the developing chamber 47 and feeds the developer accommodated in the developing chamber 47 in an arrow 511 direction in FIG. 3 while stirring the developer, and supplies the developer to the developing sleeve 44. The second screw 46 is disposed in the stirring chamber 48 and feeds the developer accommodated in the stirring chamber 48 in an arrow 510 direction in FIG. 3 while stirring the developer.

Above the developing device 4Y, a hopper 200 as a developer supplying device accommodating a supply developer 201 consisting only of the toner or consisting of the toner and the magnetic carrier is provided as shown in FIG. 2. In the hopper 200, a supplying screw 202 is provided and is capable of supplying the toner, in an amount corresponding to an amount of the toner used for image formation, from the hopper 200 to the inside of the developing container 41 through a supply opening 203 (FIG. 3). A supply amount of the developer is adjusted by a number of rotations of the supplying screw 202 by a controller 110 as a control means.

The controller 110 carries out not only control of the supplying screw 202 but also control of an entirety of the image forming apparatus 100. Such a controller 110 includes a CPU (central processing unit), a ROM (read only memory) and a RAM (random access memory). The CPU carries out control of respective portions while reading a program corresponding to a control procedure stored in the ROM. Further, in the RAM, operation data and input data are stored, and the CPU carries out control by making reference to the data stored in the RAM, on the basis of the above-described program or the like.

The developing device 4Y includes a toner content sensor 49 as a density detecting means capable of detecting a toner content (proportion of a weight of toner particles to a total weight of carrier particles and the toner particles, T/D ratio) in the developing container 41. The toner content sensor 49 is provided to the stirring chamber 48 and detects the toner content in the stirring chamber 48. In this embodiment, as the toner content sensor 49, an inductance sensor is used, and a sensor surface (detecting surface) of the inductance sensor is exposed to the inside of the stirring chamber 48. The inductance sensor detects permeability in a predetermined detection range through the sensor surface. When the toner content of the developer changes, also the permeability due to a mixing ratio between the magnetic carrier and the non-magnetic toner changes, and therefore, the change in permeability is detected by the inductance sensor, so that the toner content can be detected.

The controller 110 determines a supply amount of the developer from the hopper 200 on the basis of a result of detection of the toner content in the developing container 41 by the toner content sensor 49. Incidentally, a toner image (patch image) for control is formed on the photosensitive drum 1Y or the intermediary transfer belt 10, and a density (content) of the patch image is detected by an unshown sensor, and then a detection result thereof is reflected in the above-described supply amount in some cases. This sensor includes, for example, a light-emitting portion and a light-receiving portion, and detects the density of the patch image by receiving, at the light-receiving portion, reflected light of light emitted from the light-emitting portion toward the patch image. Further, also in some cases, the controller 110 reflects a video count value in the above-described supply amount. The video count value is a value obtained by integrating a level (for example, 0-255 levels) per (one) pixel of an inputted image data in an amount corresponding to one image screen.

[Circulation of Developer]

Next, circulation of the developer in the developing container 41 will be described. The first screw 45 and the second screw 46 are disposed substantially in parallel to each other along the rotational axis direction of the developing sleeve 44. The first screw 45 and the second screw 46 feed the developer in opposite directions along the rotational axis direction of the developing sleeve 44. Thus, the developer is circulated in the developing container 41 through the communication points 43*a* and 43*b* by the first screw 45 and the second screw 46.

That is, by a feeding force of the first screw 45 and the second screw 46, the developer, on the developing sleeve 44, in which the toner is consumed in a developing step and the toner content lowers is collected in the developing chamber 47 and is fed to the stirring chamber 48 through the communication port 43*b*, and then moves in the stirring chamber 48. Further, also the developer, in the developing chamber 47, which is not coated on the developing sleeve 44 moves in the developing chamber 47 and then moves into the stirring chamber 48 through the communication port 43*b*.

Here, on a side upstream of the communication port 43*b* of the stirring chamber 48 with respect to the developer feeding direction of the second screw 46, the supply opening 203 through which the developer is supplied from the hopper 200. For this reason, in the stirring chamber 48, the developer fed from the developing chamber 47 through the communication port 43*b* and the supply developer 201 supplied from the hopper 200 through the supply opening 203 are fed by the second screw 46 while being stirred by the second screw 46. Then, the developer fed by the second screw 46 is moved to the developing chamber 47 through the first communication port 43*a*.

In general, in a two-component developing type using the toner and the carrier, the toner and the carrier are triboelectrically contacted to each other and thus are chambered to predetermined polarities, respectively. For this reason, the two-component developing type possesses a feature such that a stress exerted on the toner is smaller than that in the case of a one-component developing type using a one-component developer.

Further, a surface area of the carrier in the developer is larger than that of the toner, and therefore, a degree of contamination of the carrier with the toner deposited on the surface of the carrier is small. However, by long-term use of the developer, an amount of contaminant (spent toner) deposited on the carrier surface increases, and for that reason, toner chambering power gradually lowers. As a result, problems such as fog and toner scattering occur. In order to realize lifetime extension of the developing device of the two-component developing type, it would be considered that an amount of the carrier accommodated in the developing device is increased, but this undesirably causes upsizing of the developing device.

For this reason, the developing device 4Y of this embodiment employs an ACR (automatic carrier refresh) type. In the ACR type, as described above, a fresh developer is supplied little by little into the developing container 41 and the developer deteriorated in charging performance is discharged little by little from the developing device, so that an increase in deteriorated carrier is suppressed. Such a developing device 4Y has a constitution in which a bulk level of the developer in the developing container 41 is roughly maintained at a certain level by discharging an excessive deteriorated developer using a bulk fluctuation of the developer. According to the developing device 4Y of this ACR type, the deteriorated carrier in the developing container 41 is replaced little by little with the fresh carrier, so that the charging performance of the carrier in the developing container 41 can be roughly maintained at a certain level.

[Developer]

Here, the two-component developer used in this embodiment will be described. As the developer, the developer obtained by mixing a negatively chargeable non-magnetic toner and a positively chargeable magnetic carrier is used. The non-magnetic toner is obtained by adding from powder of titanium oxide, silica or the like to a surface of powder prepared by incorporating a colorant, a wax component and the like into a resin material such as polyester or styrene-acrylic resin and then by subjecting a resultant mixture to pulverization or polymerization. The magnetic carrier is obtained by subjected, to resin coating, a surface layer of a core formed with ferrite particles or resin particles kneaded with magnetic powder. The content of the toner in the developer in an initial state is 8%-10%, for example.

[Stirring Property and Feeding Property of Developer]

Next, a stirring property and a feeding property of the developer by the second screw for feeding the developer in the stirring chamber will be described. To the stirring chamber, the supply developer is supplied as described above, and therefore, the second screw is required to compatibly realize the stirring property and the feeding property of the developer. First, the stirring property will be described.

In order to faithfully develop, with the toner, the electrostatic latent image formed on the photosensitive drum, it is desired that a charge amount of the toner in the developing container is stabilized. The charged amount of the toner has a tendency that the charge amount of the toner depends on the toner content (T/D ratio) of the developer. That is, when the toner content of the developer is excessively high, the toner charge amount becomes low, and when the toner content of the developer is excessively low, the toner is excessively charged electrically. With an increasing toner charge amount, an amount of the toner used for developing the latent image on the photosensitive drum becomes small, and therefore, when the toner charge amount causes non-uniformity, density non-uniformity generates on the toner image on the photosensitive drum.

Further, the toner is charged by friction with the carrier, and therefore, when the toner content of the developer is locally high in the developing container, a coating ratio of the toner to the carrier becomes excessively high, so that the toner charge amount is insufficient. As a result, toner flying (fog) to a non-image portion on the photosensitive drum, toner scattering to an outside of the developing container and the like can occur.

Further, due to an increase in toner charge amount or the like, when a bulk of the developer becomes high, the supply developer is not readily taken within a rotation radius region of the screw. For this reason, the supply developer is fed while sliding on the developer which has already existed in the developing container, so that the supply developer reaches the developing chamber while being satisfactorily stirred and thus can be scooped by the developing sleeve in some cases.

The toner content of the developer immediately after the supply developer is supplied is high, but on the other hand, the toner is consumed by the developing sleeve and thus the toner content of the developer collected in the developing container is low. Accordingly, it is desired that the above-described developers different in toner content are quickly stirred and mixed and thus the toner content of the developer in the developing container is stabilized.

Next, the feeding property of the developer will be described. In order to supply, to the developing sleeve, the toner in the same amount as a toner consumption amount proportional to an output image density, it is desired that a feeding speed of the developer is maintained by the screw at a level not less than a predetermined speed. When the developer feeding speed is slow, in the case where images with a high image density are continuously formed, a time until the supplied developer reaches the developing sleeve becomes large (slow). Then, the toner content of the developer scooped by the developing sleeve lowers, so that the image density gradually becomes thick. For this reason, it is desired that the supplied developer is caused to quickly reach the developing sleeve by ensuring the developer feeding speed at a level not less than a predetermined speed. Thus, the second screw for feeding the developer immediately after being supplied is desired to compatibly realize ensuring of the developer stirring property and ensuring of the developer feeding property.

Figure 4:
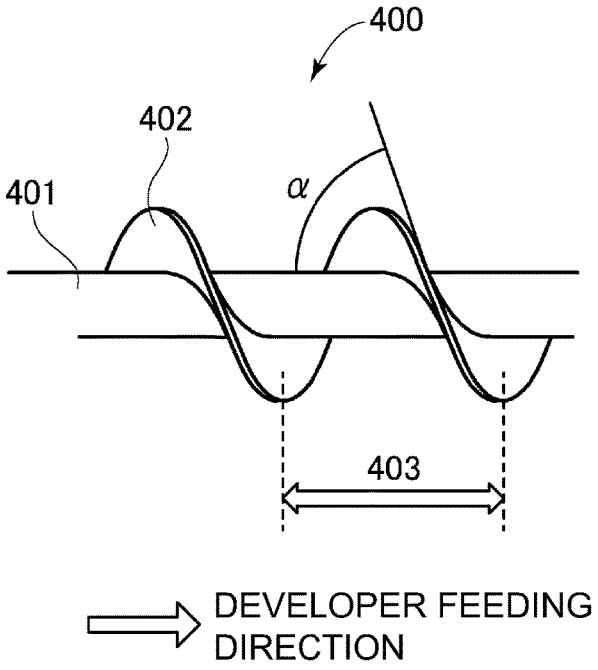
FIG. 4 is a schematic view showing an angle of a feeding surface of a blade.

Next, a pitch of a blade 402 and the developer feeding property in the case where a single thread feeding screw 400 shown in FIG. 4 is used as the screw for feeding the developer in the developing container will be described. The feeding screw 400 includes a single thread blade 402 helically formed around a rotation shaft 401. In an example of FIG. 4, the case where a screw outer diameter is 14 mm is shown.

A developer feeding amount per (one) rotation of the feeding screw changes depending on a pitch 403 of the blade 402. Assuming that all of the developer is carried while following the helical blade 402. A distance in which the developer travels (moves) during one rotation of the feeding screw 400 is equal to the pitch 403 of the blade 402.

However, in actuality, the developer sliding on the blade 402 exists, and therefore, there is no case where all the developer is fed while following the blade 402. When the pitch 403 is gradually increased, an angle $\alpha$ of the feeding surface of the blade 402 gradually becomes small, and therefore, an amount of the developer sliding on the above-described blade 402.

Figure 5:
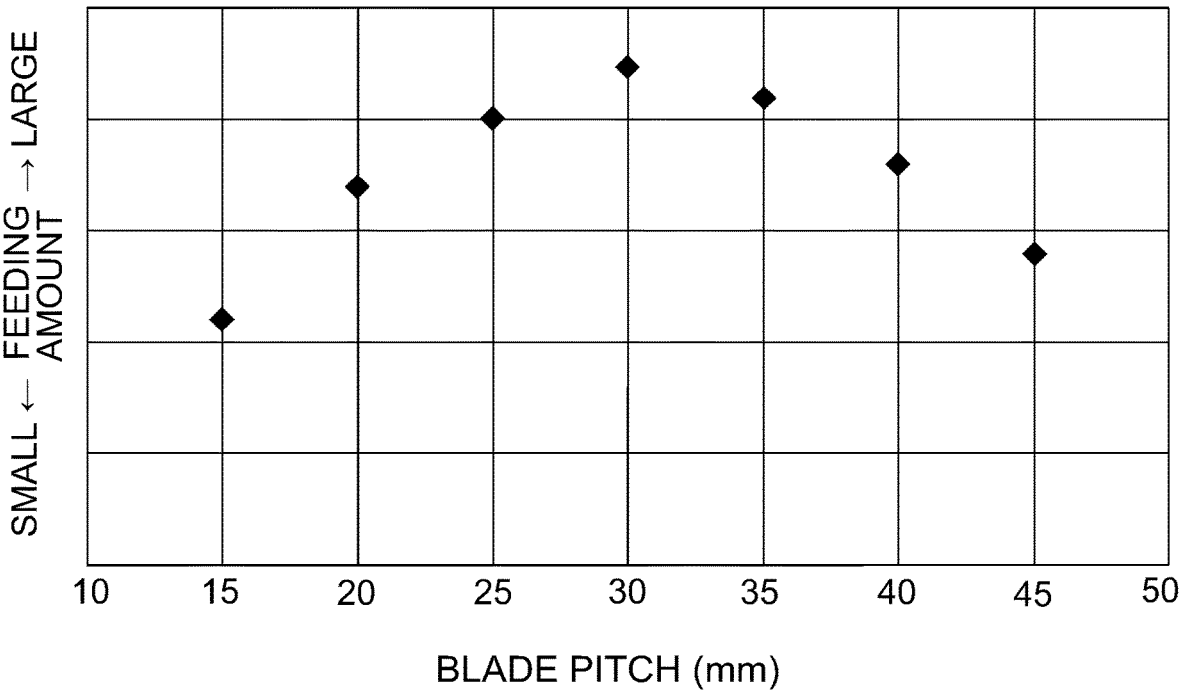
FIG. 5 is a graph showing a relationship between a pitch of the blade and a feeding amount of a developer.

FIG. 5 shows a result of measurement of the developer feeding amount per rotation when the pitch 403 of the blade 402 is changed. A relationship between the pitch 403 of the feeding screw 400 and the developer feeding amount per rotation of the feeding screw 400 provides a graph as shown in FIG. 5. In FIG. 5, the developer feeding amount per rotation becomes largest when the pitch 403 is 30 mm. Incidentally, in the case where the screw outer diameter is changed, a shape of the graph indicated in FIG. 5 is different therefrom, so that the pitch to which this embodiment is applicable is not limited thereto.

As described above, it is desired that ensuring of the developer stirring property and ensuring of the developer feeding property are compatibly realized. Particularly, in the case where the amount of the developer accommodated in the developing container is decreased by downsizing the developing device it is difficult to compatibly realize ensuring of the developer feeding property and ensuring of the developer stirring property. For example, in the case where the developing device is downsized, it would be considered that an outer diameter of the feeding screw is decreased, but in the case, an area in which the developer is pushed by the blade is decreased, and therefore, the developer feeding property of the feeding screw is liable to lower.

Further, in a constitution in which the developer in a small amount is accommodated in a small-sized developing device, it is desired that the developer in the developing container is circulated at a high speed in order to supply the developer to the developing sleeve. In such a developing device, it is desired that not only the developer is supplied onto the developing sleeve, but also when the toner in an amount depending on an image output of the image forming apparatus is supplied into the developing container, the supplied toner and the developer which remains in a small amount in the developing container can be quickly stirred sufficiently.

[Second Screw of this Embodiment]

Therefore, in this embodiment, each of the first screw 45 and the second screw 46 is prepared in the form of the multi-thread screw including the plurality of blades provided with threads. Further, as regards the second screw 46 for feeding the developer in the stirring chamber 48, a helix angle is made not more than 56.5°. In the following, the second screw 46 will be specifically described with reference to FIGS. 6 and 7.

Figure 6:
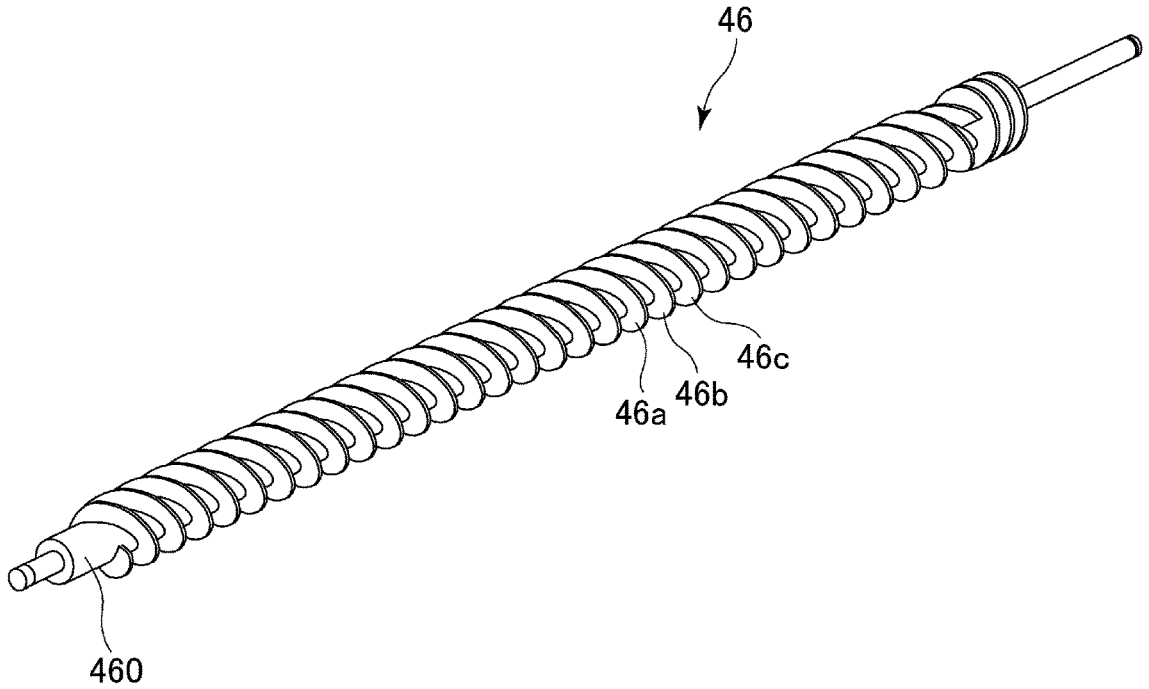
FIG. 6 is a perspective view showing a second screw according to the First Embodiment.

As shown in FIG. 6, the second screw 46 includes a rotation shaft 460 and includes, at a periphery of the rotation shaft 460, a plurality of blades 46*a*, 46*b* and 46*c* provided with threads. In this embodiment, the second screw 46 is a three-thread screw including three blades 46*a*, 46*b* and 46*c* provided with threads. Further, each of the plurality of blades 46*a*, 46*b* and 46*c* has a continuous shape over an axial direction of the rotation shaft 460. The three blades 46*a*, 46*b* and 46*c* providing the three threads are formed in the named order with the same outer diameter and the same lead with respect to the developer feeding direction of the second screw 46.

Figure 7:
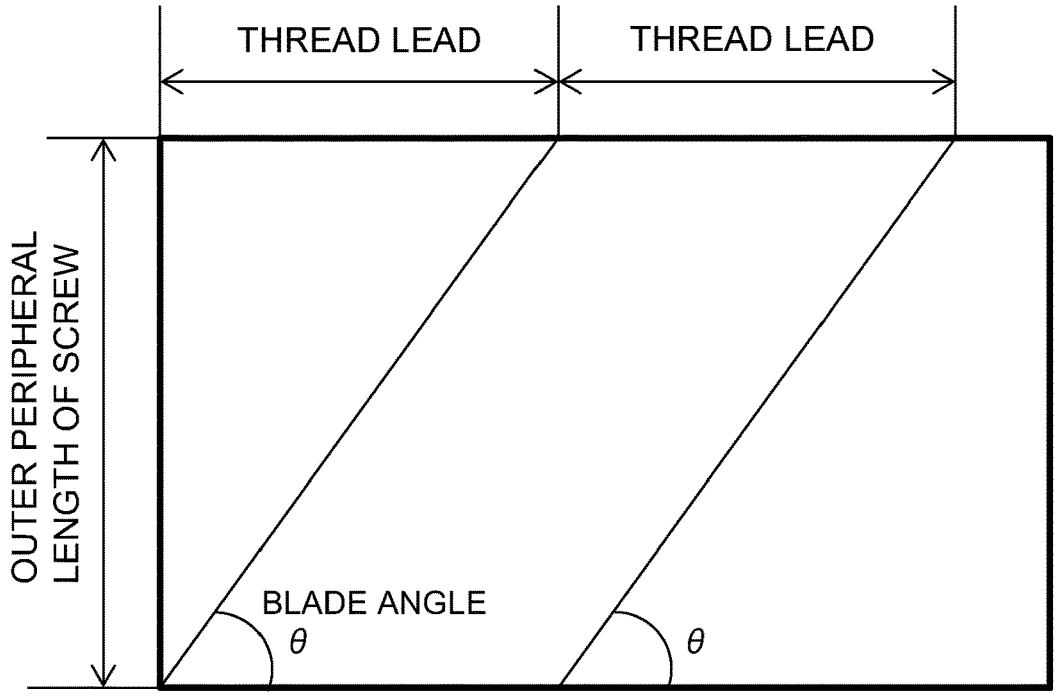
FIG. 7 is a schematic view for illustrating a helix angle of the blade.

Here, FIG. 7 is a schematic view for illustrating an angle of the helical blade, wherein a length of an outer periphery of a circle with a diameter equal to an outer diameter of each of the blades 46*a*, 46*b* and 46*c* (i.e., a screw outer peripheral length) is the ordinate and a length of the blade 46*c* with respect to an axial direction is the abscissa. An angle formed between a crest of the helical blade and the abscissa is an angle θ (helix angle) of the blade 46*c*. Incidentally, the outer diameters of the blades 46*a*, 46*b* and 46*c* are the outer diameter of the second screw 46 and correspond to those of circles in which distances from a center of the rotation shaft 460 to outer peripheral surfaces of the blades 46*a*, 46*b* and 46*c* are radii of the circles, in a cross-section perpendicular to the rotation shaft 460. In this case, the helix angle 9 of each of the blades 46*a*, 46*b* and 46*c* is 56.5° or less. Particularly, the helix angle 9 of each of the blades 46*a*, 46*b* and 46*c* may preferably be 39° or more and 56.5° or less, more preferably be 50° or more and 56.5° or less.

Further, the outer diameter of the second screw 46 may preferably be 12 mm or more and 20 mm or less, more preferably be 14 mm or more and 17 mm or less. For example, the outer diameters of the blades 46*a*, 46*b* and 46*c* of the second blade 46 are 14 mm, and the leads of the blades 46*a*, 46*b* and 46*c* of the second blade 46 are 30 mm. As a result, in this embodiment, the helix angle θ of each of the blades 46*a*, 46*b* and 46*c* is 55.7°.

According to study by the present inventors, it turned out that in the multi-thread screw, the above-described helix angle θ is made not more than 56.5°, the ensuring of the developer feeding property and the ensuring of the developer stirring property can be compatibly realized. That is, when the helix angle θ is excessively large, the screw lead is smaller than the screw outer peripheral length, and therefore, as shown in FIG. 5 described above, the developer feeding amount lowers. Further, when the helix angle θ is excessively large and the screw lead is small, also the angle α of the feeding surface of the blade (FIG. 4) increases, so that the stirring property of the developer by the blades lowers. For this reason, in this embodiment, the helix angle θ is made not more than 56.5°.

On the other hand, when the helix angle θ is excessively small, the screw lead is larger than the screw outer peripheral length, and therefore, also as shown in FIG. 5, the developer feeding amount lowers. For this reason, the helix angle θ may preferably be 39° or more, more preferably be 50° or more.

Incidentally, the first screw 45 and the second screw 46 are, for example, 30 mm in lead, 14 mm in screw outer diameter, and 6 mm in diameter of the rotation shaft. However, the diameter of the rotation shaft of the first screw 45 may also be somewhat larger 8 e.g., 8 mm) than the diameter of the rotation shaft of the second screw 46. Further, longitudinal widths of the communication ports 43*a* and 43*b* of the developing container 41 are 30 mm, for example.

When the first screw 45 circulates the developer in the developing container 41 in combination with the second screw 46 is taken into consideration, the developer feeding property of the first screw 45 may desirably be equivalent to that of the second screw 46. That is, the first screw 45 may preferably have the same constitution as that of the second screw 46 in terms of not only a rotational speed but also number of threads and the lead.

Further, in the case of this embodiment, stirring distance coefficient described below may preferably be 2.0 or more and 4.9 or less, more preferably be 2.0 or more and 3.7 or less. Here, a sum of outer peripheral lengths of the blades 46*a*, 46*b* and 46*c* each in one lead is a sum of screw outer peripheral distances. Further, an outer peripheral length of a circle when the outer diameter of the blades 46*a*, 46*b* and 46*c* is a diameter (2×radius (distance from center of rotation shaft to outer peripheral surface of blade)) is an outer peripheral length of a screw outer diameter portion. In this case, a value obtained by dividing "sum of screw outer peripheral distances" by "outer peripheral length of screw outer diameter portion" is defined as the stirring distance coefficient. That is, as regards the second screw 46 in this embodiment, the "some of screw outer peripheral distances" may preferably be two times or more and 4.9 times or less the "outer peripheral length of screw outer diameter portion" and may more preferably be two times or more and 3.7 times or less the "outer peripheral length of screw outer diameter portion".

The screw outer peripheral distance corresponds to an amount in which the second feeding screw 46 feeds the developer per (one) rotation of the second feeding screw 46, and with an increase of this distance, the second feeding screw 46 feeds the developer in a larger amount. Further, it can also be said that with an increasing screw outer peripheral distance, the supplied toner and the developer in a larger amount are fed while being stirred.

Here, the screw outer peripheral distance is determined also depending on the outer diameter of the screw, the helix angle θ or the screw pitch, and as described above, a proper screw outer peripheral distance can be obtained by selecting the screw outer diameter and the helix angle θ which are capable of providing a good developer feeding property of the feeding screw. In the multi-thread screw, the sum of the screw outer peripheral distances of the respective blades corresponds to an amount in which the screw feeds the developer while stirring the developer, per (one) rotation of the screw. Accordingly, in the case of the multi-thread screw, the screw outer peripheral distance increases in proportion to the number of threads, and therefore, it would be considered that a performance of the screw gradually improves in proportion to the number of threads.

However, in actuality, when the number of threads of the multi-thread screw excessively increases, a volume of the blades for constituting the screw becomes large, and therefore, the developer stirring property and the developer feeding property by the screw rather lower. For this reason, it is not preferable that the number of threads of the screw simply excessively increases.

Further, as described above, the screw outer peripheral distance changes also depending on the outer diameter of the screw. When the screw outer diameter is increased, the screw outer peripheral distance becomes large, but the developing container is upsized thereby. For this reason, in this embodiment, as an index of the feeding property and the stirring property of the screw which do not rely on the screw outer diameter, as described above, the stirring distance coefficient ([stirring distance coefficient]=[sum of screw outer peripheral distances]/[outer peripheral length of screw outer diameter portion]) was employed.

[Stirring Performance]

Figure 8:
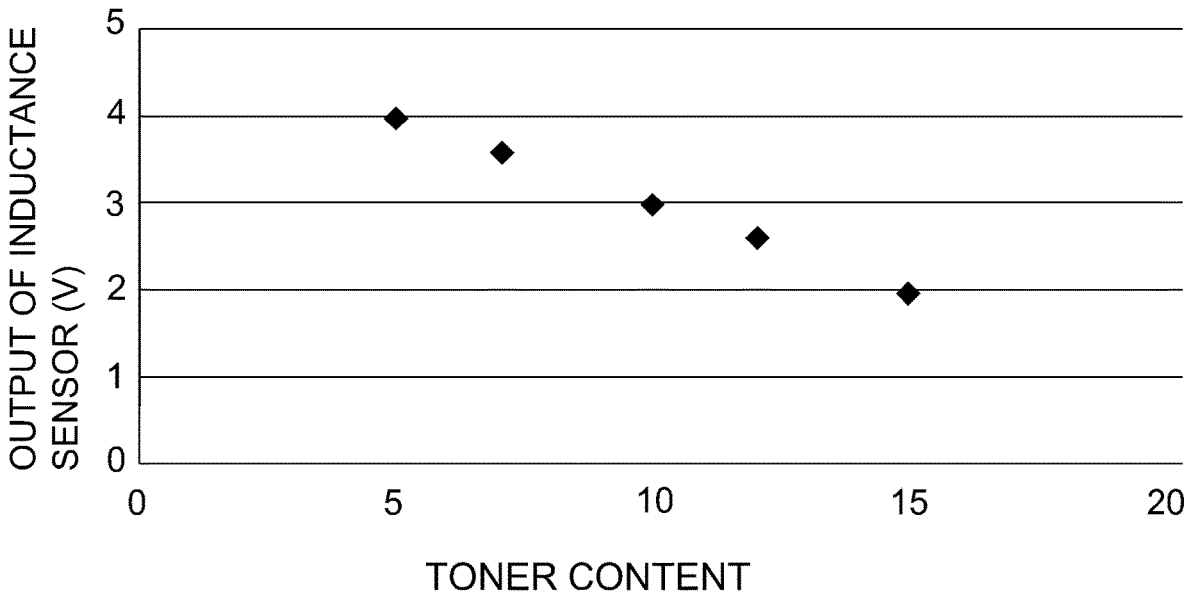
FIG. 8 is a graph showing a relationship between a toner content and an output of an inductance sensor.

Next, a method of verifying a stirring performance when the supplied toner is stirred with the developer by the screw will be described using FIGS. 8-10. Verification of the stirring performance of the supplied toner with the developer can be conducted by checking a degree of mixing of the supplied toner in the developer when the supplied toner is added into the developing container in which the developer is accommodated. In this embodiment, this check was carried out by using the developing container 41 shown in FIGS. 2 and 3.

The above-described degree of mixing of the supplied toner can be evaluated by checking a change in toner content of the developer in the developing container 41, and in this verification, measurement of the change in toner content was performed by the toner content sensor 49 provided in the developing container 41. As described above, as the toner content sensor 49, the inductance sensor for detecting a magnetic characteristic was used, so that the toner content in the neighborhood of the sensor was detected.

Here, the inductance sensor used as the toner content sensor 49 will be specifically described. The inductance sensor is a content (density) sensor for detecting information on permeability of the developer. As described above, the developer (two-component developer) contains the magnetic carrier and the non-magnetic toner as main components. When the toner content (proportion of the weight of toner particles to the total weight of carrier particles and the toner particles) of this developer changes, also the permeability depending on a mixing ratio between the magnetic carrier and the non-magnetic toner changes. The change in permeability is detected by the inductance sensor.

The inductance sensor is disposed opposed to the second screw 46 while the sensor surface (detecting surface) for detecting the permeability is projected into the stirring chamber 48. The sensor surface was disposed close to the second screw 46 in consideration of a developer stirring and feeding property on the sensor surface. A distance between an outer diameter surface of the second screw 46 (i.e., a cylindrical surface with the screw outer diameter as a diameter) and the sensor surface is G. According to study by the present inventors, from a relationship of sensor sensitivity, it turned out that the distance G may preferably be about 0.2-2.5 mm.

However, there is a liability that when the sensor surface is brought near to the second screw 46 excessively, the outer diameter surface of the second screw 46 contacts the sensor surface and thus the sensor surface is abraded by rotation of the second screw 46. When the second screw 46 contacts the sensor surface, deformation of the sensor surface, inclusion of abraded powder into the developing container and the like generate. When the sensor surface is brought near to the second screw 46 excessively, there is a liability that the developer between the sensor surface and the second screw 46 is flattened and an aggregate is formed and causes an image deterioration. For this reason, in the developing device 4Y of this embodiment, the distance G was set at 0.5 mm.

The inductance sensor detects the permeability in a predetermined detection range from the sensor surface, and therefore, detected permeability also changes with motion of the second screw 46. Specifically, the developer passes through the sensor surface of the inductance sensor along a screw rotation cyclic period, and therefore, a signal waveform of the permeability detected by the inductance sensor is a signal waveform including a maximum and a minimum depending on the motion of the second screw 46.

In this embodiment, detection of the permeability of the developer by the inductance sensor was carried out every 10 ms. The detection every 10 ms was carried out correspondingly to one-full circumference of the screw (correspondingly to a time required for one-full turn and calculated from a rotational speed of the second screw 46) corresponding to between adjacent maximums values (peaks) of the waveform, and an average of detected values was acquired and was used as a detection value of the inductance sensor. An electric signal detected by the inductance sensor changes, as shown in FIG. 8, substantially linearly depending on the toner content. That is, the electric signal outputted from the inductance sensor corresponds to the toner content of the two-component developer in the developing container 41.

Processing of the electric signal outputted from the inductance sensor will be described. The electric signal from the inductance sensor is sent to the CPU in the controller 110 (FIG. 2). Then, in the CPU, a predetermined toner content (toner content as an initial setting value stored in a storing circuit such as the RAM) and an actual toner content (detected value by the inductance sensor) in the developing container 41 are compared with each other, and a result thereof is recorded. When the toner content is detected by the inductance sensor, as described above, the detected value changes with the motion of the second screw 46. Therefore, the change in detected value by the motion of the second screw 46 was calculated by using the average of the permeability per rotation cyclic period of the screw as the detected value, and then the toner content was calculated by the above-described processing.

Figure 9:
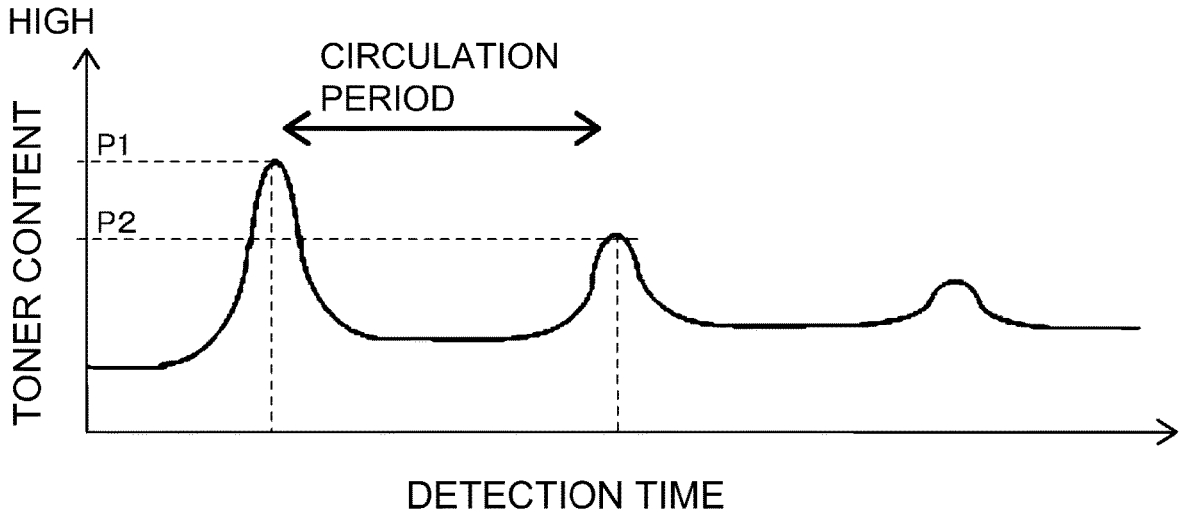
FIG. 9 is a graph showing a relationship between a detection time of a toner content sensor and the toner content in the neighborhood of the toner content sensor.

FIG. 9 is a graph showing a time progression of the toner content at a portion in the neighborhood of the sensor when the abscissa represents a detection time of the toner content sensor 49 (inductance sensor). The ordinate represents the toner content (i.e., a value obtained by converting an output result of the toner content sensor 49 into the toner content) in the neighborhood of the sensor, and the graph shows that when this value is large, the toner content is high.

When the supplied toner supplied into the developing container 41 is fed in a circulation path in the developing container 41 and reaches the neighborhood of the toner content sensor 49, at the portion in the neighborhood of the sensor, the toner content is temporarily detected as a high value. Thereafter, when the supplied toner passes through the portion in the neighborhood of the sensor, the toner content at the portion in the neighborhood of the sensor converges to a value close to an original toner content.

Every time when the supplied toner is circulated in the developing container 41 and passes through the neighborhood of the toner content sensor 49, such an abrupt change in toner content is repeated. That is, as shown in FIG. 9, an abrupt increase (peak) in toner content is repeated with a circulation cyclic period of the developer in the developing container 41. However, when the circulation of the developer advances, the supplied toner is stirred with the developer, so that a peak value of the toner content detected by the toner content sensor 49 lowers. Then, finally, the toner content converges to a value higher than a value before supply of the supplied toner by a proportion corresponding to the amount of the supplied toner.

Here, attention is paid to the peak value of the toner content detected by the toner content sensor 49 as shown in FIG. 9. A first peak value of the toner content when the supplied toner passes once through the neighborhood of the sensor is P1 (%). Further, a second peak of the toner content when the supplied toner passed once through the neighborhood of the sensor passes again through the neighborhood of the sensor via the circulation path is P2 (%). In this case, when P2 is lower than P1, this means that the supplied toner is stirred with the developer correspondingly. For this reason, the stirring performance of the supplied toner in the developing device can be represented by a lowering ratio (peak change value from P1 to P2).

[Peak Change Value and Density Non-Uniformity]

Next, a relationship between a peak change value Δ (%) of the above-described toner content in the neighborhood of the sensor and density non-uniformity when the image is actually outputted using the developing device providing the respective peak values will be described. The change in toner content in the developing container 41 appears as the density non-uniformity of an output image. In this study, in the image forming apparatus shown in FIG. 1, when a solid image was outputted using the developing device providing the respective peak values, the relationship between apparent density non-uniformity on the output image and the peak change value was checked.

Incidentally, the solid image is a toner image formed on an entire surface of an image formable region of the photosensitive drum and refers to the case where an image ratio (print ratio) is 100%. Further, in an experiment, a job in which solid images were outputted on a plurality of sheets was carried out. As a result, in the case where the supplied toner in an amount corresponding to an amount of the solid images is supplied to the developing container and is used for developing the electrostatic latent images without being sufficiently stirred, the density non-uniformity of the output images can generate. Accordingly, in this experiment, the thus generating density non-uniformity was checked.

Figure 10:
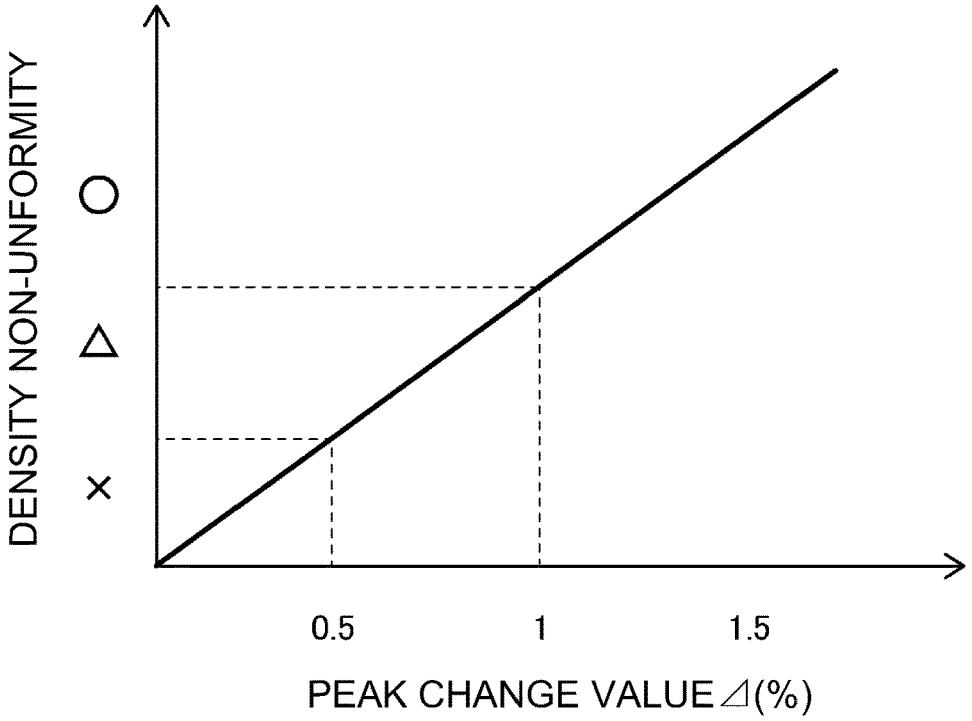
FIG. 10 is a graph showing a relationship between a peak change value and density non-uniformity.

A result of the experiment is shown in a graph of FIG. 10. In the graph of FIG. 10, a state in which there was no density non-uniformity was indicated as "○", a state in which a degree of the density non-uniformity was small was indicated as "Δ", and a state in which the degree of the density non-uniformity was large was indicated as "x". As apparent from FIG. 10, when the peak change value Δ (%) was 1.0 or more, the state in which there was no density non-uniformity was formed, and when the peak change value Δ (%) was 0.5 or more and less than 1.0, the state in which the degree of the density non-uniformity was small was formed. On the other hand, when the peak change value Δ (%) was less than 0.5, the density non-uniformity on the images remarkably generated. Accordingly, in order to suppress the density non-uniformity of the output images, the peak change value Δ (%) may preferably be not less than 0.5, more preferably be not less than 1.0.

[Stirring Distance Coefficient and Peak Change Value]

Figure 11:
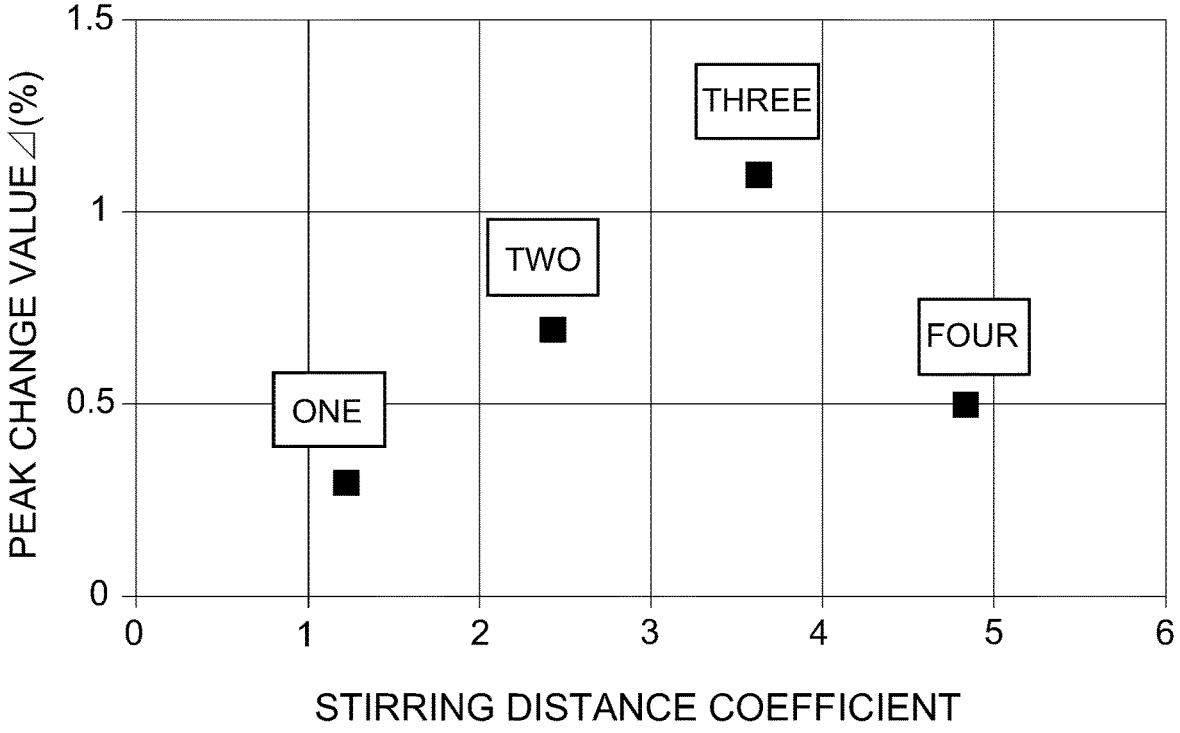
FIG. 11 is a graph showing a relationship between stirring distance coefficient and the peak change value.

Next, an experiment in which a relationship between the stirring distance coefficient and the peak change value was checked will be described. In the experiment, second screws different in number of threads were prepared. Values of the stirring distance coefficient of the respective second screws were set as shown in FIG. 11. Incidentally, helix angles of the respective second screws were 56.5° or less. Then, the peak change values of the toner content sensor 49 in the case where the respective second screws were used were checked.

An experimental condition is as follows. First, as an initial developer, 200 g of a developer with a toner content of 10% was placed in the developing container as shown in FIGS. 2 and 3. Then, as supplied toner, 1 g of supply toner was placed in the supply opening. At this time, in a state in which the developer had already been accommodated in the developing container 41, each of the second screws 46 was rotated at a rotational speed of 600 rpm, and in this state, the supplied toner was added. Then, the peak change value Δ (%) as described with reference to FIG. 9 was calculated. This result is shown in FIG. 11.

In a graph of FIG. 11, the abscissa represents the stirring distance coefficient, and the ordinate represents the peak change value Δ (%). As described above, when the peak change value Δ (%) of the toner content in the neighborhood of the sensor is large, it shows that the supplied toner is satisfactorily stirred. Further, from FIG. 10, in order to suppress the density non-uniformity on the image, the peak change value Δ (%) may preferably be not less than 0.5, more preferably be not less than 1.0.

From FIG. 11, it turned out that in the case where the stirring distance coefficient was 2 or more and 4.9 or less, i.e., in the cases of the two-thread screw, the three-thread screw and the four-thread screw, the peak change value Δ (%) was not less than 0.5. Further, it turned out that in the case of the three-thread screw providing the stirring distance coefficient was 3.7 or less, the peak change value Δ (%) was not less than 1.0. Accordingly, it turned out that in the case where the multi-thread screw providing the stirring distance coefficient of 2 or more and 4.9 or less was used as the second screw 46, the density non-uniformity of the image was able to be suppressed. Further, it turned out that the multi-thread screw providing the stirring distance coefficient of 2 or more and 3.7 or less was used as the second screw 46, the output image less causing the density non-uniformity was able to be obtained.

As described above, as in this embodiment, by making the helix angle θ of the multi-thread screw as the second screw 46 not more than 56.5°, it is possible to compatibly realize the ensuring of the developer feeding property and the ensuring of the developer stirring property. Further, by making the stirring distance coefficient 2 or more and 4.9 or less, preferably 2 or more and 3.7 or less, the ensuring of the developer feeding property and the ensuring of the developer stirring property are compatible realized, so that the generation of the density non-uniformity of the output image can be suppressed. Incidentally, the blade portion satisfying such a condition is not necessarily be provided in the entire screw region, but also by a constitution in which the blade portion satisfying such a condition is provided in a partial section of the entire screw region, the ensuring of the feeding property and the ensuring of the stirring property can be compatibly realized. Such a section of the blade portion is further effective when the section is provided in a region downstream of the supplying portion 203 and upstream of the toner content sensor 49 with respect to the developer feeding direction of the second screw 46.

Second Embodiment

A Second Embodiment will be described using parts (a) and (b) of FIG. 12 and FIG. 13 while making reference to FIGS. 2 and 3. In the above-described First Embodiment, the constitution in which the three-thread screw providing the helix angle θ of 56.5° or less was used as the second screw was described. On the other hand, in the case of this embodiment, a constitution where as a second screw 46A for feeding the developer in the stirring chamber 48 while stirring the developer, a screw in which at least one blade (thread) of a plurality of blades (threads) is provided with a gap portion is provided is employed. Other constitution and actions are similar to those in the above-described First Embodiment. In the following, constituent elements similar to those in the First Embodiment will be omitted from description and illustration or will be briefly described, and in the following, a portion different from First Embodiment will be principally described.

As shown in part (a) of FIG. 12, the second screw 46A includes a rotation shaft 460 and a plurality of blades (threads) 46Aa and 46Ab which are helically formed around the rotation shaft 460. In this embodiment, the second screw 46A is a two-thread screw including two blades (threads) 46Aa and 46Ab. Further, of these (plurality of) blades (threads) 46Aa and 46Ab, the blade 46Aa as the first blade provided with at least one thread (one threads in this embodiment) has a continuous shape over the axial direction of the rotation shaft 460. Incidentally, the angles θ of the blades 46Aa and 46Ab may preferably be 39° or more and 80° or less, preferably be 56.5° or less.

On the other hand, the blade 46Ab as the second blade which is different from the first blade and which is provided with at least one thread (single thread in this embodiment) has a shape including a gap portion 46Ag in which the blade 46Ab is discontinuous on at least a part of the rotation shaft 460 with respect to the axial direction.

That is, a part of the blade 46Ab is removed, and this part constitutes gap portion 46Ag. The two blades 46Aa and 46Ab providing the two threads are formed in the named order with the same outer diameter and the same lead with respect to the developer feeding direction of the second screw 46A.

Incidentally, the first screw for stirring and feeding the developer in the developing chamber 47 is a two-thread screw similar to the second screw 46A but is not provided with the gap portion at any of the blades. However, also the first screw may have a shape including the gap portion in at least one blade (thread) similarly as in the case of the second screw 46A. Further, the first screw may preferably be a screw which has the same outer diameter, pitch and number of threads as those of the second screw 46A, and in this case, the gap portion may be provided similarly as in the case of the second screw 46A and may also be not provided.

Further, the blade 46Ab includes the gap portions 46Ag formed periodically over an entire area of the blade 46Ab with respect to the axial direction in a region between the communication ports 43*a* and 43*b*. In this embodiment, the blade 46Ab and the gap portion 46Ag are disposed so that with respect to a phase of the second screw 46A along a rotational direction of the second screw 46A, the blade 46Ab with the phase of 120° and the gap portion 46Ag with the phase of 60° alternately exist. That is, in this embodiment, the gap portion 46Ag has the phase of less than 180°.

Accordingly, as shown in part (b) of FIG. 12, an areal ratio between the blade 46Ab and the gap portion 46Ag when the portions of the blade 46Ab are projected in the axial direction through one-full circumference is 2:1.

The developer is fed from a right side to a left side in part (a) of FIG. 12. In this case, the developer fed toward the downstream blade 46Ab is divided at the gap portion 46Ab into the developer in a region in which the developer is fed by the blade 46Ab and the developer in a region in which the developer is fed by the blade 46Aa immediately upstream of the blade 46Ab. On the other hand, the developer fed to the upstream blade 46Aa is divided at the gap portion 46Ag into the developer in a region in which the developer is fed by the blade 46Aa and the developer in a region in which the developer is fed by the blade 46Ab immediately downstream of the blade 46Aa. Thus, the developer feeding path is divided into two regions by the gap portion 46Ag, so that in the case where the toner is supplied or in the like case, the supplied toner is easily distributed broadly into the developer. Then, by broadening of the distribution of the supplied toner into the developer, the stirring property of the supplied toner with the developer is improved.

Incidentally, both of the blades 46Aa and 46Ab of the second screw 46A of this embodiment are 30 mm in lead, 14 mm in screw outer diameter, and 6 mm in diameter of the rotation shaft 460. Here, also the lead of the blade 46Ab may desirably be a screw lead determined in consideration of the feeding property as described with reference to FIG. 5. For this reason, as regards the lead of the blade 46Ab in this embodiment, the 30 mm-lead in which the feeding property is good similarly as in the case of the blade 46Aa is employed.

Further, as regards the gap (interval) between the blades 46Aa and 46Ab with respect to the axial direction it is desired that the blade 46Ab is in a position dividing the lead between adjacent portions of the blade 46Aa into two equal parts. This is because as described above, when the flow of the developer is divided by the gap portion 46Ag, the division into the side where the developer flows toward the upstream side and the side where the developer flows toward the downstream side is effective in improving the developer stirring property.

Next, the stirring distance coefficient and the stirring property (performance) of the second screw 46A will be described. As described above, by employing the constitution in which the screw including at least one blade (thread) 46Ab provided with the gap portion 46Ag is used as the second screw 46A, the developer stirring performance can be improved. However, even in such a constitution, similarly as in the First Embodiment, the developer stirring performance of the screw changes also depending on the stirring distance coefficient.

Also in the case of this embodiment, the stirring distance coefficient of the second screw 46A is 0.5 or more and 4.9 or less, preferably 2.0 or more and 3.7 or less. That is, as regards the second screw 46A, the "sum of screw outer peripheral distances" is 0.5 time or more and 4.9 times or less the "outer peripheral length of screw outer diameter portion", preferably 2 times or more and 3.7 times or less the "outer peripheral length of screw outer diameter portion".

Here, an experiment in which in the above-described constitution of the two-thread screw, a difference in stirring performance with respect to the stirring distance coefficient is checked will be described. In the experiment, screws in which in the above-described two-thread screw, a ratio between a blade portion and the gap portion 46Ag of the blade 46Ab (i.e., an areal ratio between the blade portion of the blade 46Ab projected in the axial direction correspondingly to one-full circumference and the gap portion 46Ag was changed were prepared. The ratios between the blade 46Ab and the gap portion 46Ag of the respective two-thread screws are set as shown in FIG. 13, and values of the stirring distance coefficient at that time are as shown in FIG. 13. Incidentally, the helix angle of each of the respective two-thread screws was set at not more than a 56.5°. Further, the peak change value of the toner content sensor 49 in the case where each of the two-thread screws was used as the second screw was checked.

An experimental condition was similar to that in the case of the First Embodiment shown in FIG. 11. An initial developer was placed in the developing container 41 as shown in FIGS. 2 and 3, and then a supplied toner was added. At that time, the peak change value Δ (%) of the toner content sensor 49 was calculated. A result thereof is shown in FIG. 13.

Also in a graph of FIG. 13, the abscissa represents the stirring distance coefficient, and the ordinate represents the peak change value Δ (%). As regards a ratio between a region where the screw blade 46Ab is provided and a region where the screw blade 46Ab is not provided but the gap portion 46Ag is provided, as shown in part (b) of FIG. 12, a ratio when the region of the gap portion 46Ag is taken as 1.

From FIG. 13, it turned out that in the constitution of the two-thread screw including the gap portion 46Ag, the peak change value can be made 1.0 or more by setting the ratio between the region where the blade 46Ab exists and the region of the gap portion 46Ag at 2:1 or more, i.e., by setting the stirring distance coefficient at 2 or more. Incidentally, it turned out that even when the ratio was 1:1 and 1.5:1, the peak change value can be made 0.5 or more. Accordingly, it turned out that the ratio between the region where the blade 46Ab exists and the region of the gap portion 46Ag may preferably be not less than 1:1, more preferably be not less than 2:1.

Also in such a case of this embodiment, similarly as in the First Embodiment, the ensuring of the developer feeding property and the ensuring of the developer stirring property are compatibly realized, so that the generation of the density non-uniformity of the output image can be suppressed.

Incidentally, when the stirring distance coefficient of the second screw 46A satisfies the above-described range, the above-described ratio and regularity of the blade existing portion and the gap portion can be appropriately set. For example, the blade and the gap portion may be combined every arbitrary phase, and the second screw 46A may also have a shape such that the gap portion is not partly provided at a part thereof with respect to the developer feeding direction (longitudinal direction). Incidentally, the blade portion satisfying such a condition is not necessarily provided in the entire region of the screw, but by also the constitution in which the blade portion satisfying such a condition is provided in a partial section, it is possible to compatibly realize the ensuring of the developer feeding property and the ensuring of the developer stirring property.

Further, in the case where the gap portion-containing blade of the second screw has a shape such that the gap portion is disposed in a partial region and is not disposed in another region with respect to the axial direction, the gap portion is disposed so as to exist at least downstream of the supplying portion 203 and upstream of the toner content sensor 49 with respect to the developer feeding direction of the second screw. In a preferred example, the gap portion is disposed so as to exist at least immediately upstream of the toner content sensor 49 (for example, within two pitches of the gap portion-containing blade from an upstream end of the sensor surface).

This is because the developer is sufficiently stirred before the developer reaches the toner content sensor 49. That is, in the case where the toner content of the developer which is not sufficiently stirred is detected by the toner content sensor 49, detection accuracy of the toner content in the developing container lowers, so that control such as the supply of the developer on the basis of the detection result of the toner content sensor 49 is not readily carried out properly. Accordingly, the gap portion may preferably be caused to exist in a side upstream of the toner content sensor 49 so that the developer can be sufficiently stirred before reaching the toner content sensor 49.

Another Example of the Second Embodiment

In the Second Embodiment, the constitution in which only one blade (thread) of the two blades (threads) of the two-thread screw is provided with the discontinuous gap portion was described, but the stirring property can be improved also by employing a constitution in which both of the two blades (threads) are provided with the discontinuous gap portions. Even in such a constitution, similarly as in the First and Second Embodiments, the stirring distance coefficient of the screw has the influence on the stirring performance, and therefore also this point was checked. As a result, even in the constitution in which both of the blades of the two-thread screw are provided with the gap portions, similarly as in the case shown in FIG. 13, results of the stirring distance coefficient and the peak change value Δ (%) were obtained.

Accordingly, even in the constitution in which both of the blades of the two-thread screw are provided with the gap portions, by making the stirring distance coefficient 0.5 or more and 4.9 or less, the ensuring of the developer feeding property and the ensuring of the developer stirring property are compatibly realized, so that the generation of the density non-uniformity of the output image can be suppressed. In a preferred example, by making the stirring distance coefficient 2 or more and 3.7 or less, the density non-uniformity of the output image can be further suppressed.

For example, both of the blades of the two-thread screw are provided with the gap portions each providing the ratio between the blade and the gap portion of 85:15. By using such a ratio, the stirring distance coefficient can be made 2 or more, so that the peak change value Δ (%) was able to be made 1.0 or more.

Incidentally, also in the constitution in which both of the blades of the two-thread screw are provided with the gap portions, when the stirring distance coefficient satisfies the above-described range, the above-described ratio and the regularity of the blade-existing portion and the gap portion can be appropriately set. For example, the blade and the gap portion may be combined with each other every arbitrary phase, and the screw may also have a shape such that the gap portion is not partly provided at a part thereof with respect to the developer feeding direction (longitudinal direction).

Third Embodiment

A Third Embodiment will be described using FIG. 14 while making reference to FIGS. 2 and 3. In the above-described Second Embodiment, the constitution in which at least one blade of the two-thread screw was provided with the gap portion was described. On the other hand, in the case of this embodiment, a constitution where as a second screw 46B for feeding the developer in the stirring chamber 48 while stirring the developer, a screw in which at least one blade (thread) of three of blades (threads) is provided with a gap portion is provided is employed. Other constitution and actions are similar to those in the above-described Second Embodiment. In the following, constituent elements similar to those in Second Embodiment will be omitted from description and illustration or will be briefly described, and in the following, a portion different from the Second Embodiment will be principally described.

As shown in FIG. 14, the second screw 46B includes a rotation shaft 460 and a plurality of blades (threads) 46Ba, 46Bb and 46Bc which are helically formed around the rotation shaft 460. In this embodiment, the second screw 46B is a three-thread screw including three blades (threads) 46Ba, 46Bb and 46Bc. Further, of these (plurality of) blades (threads) 46Ba, 46Bb and 46Bc, the blades 46Ba and 46Bb as the first blade provided with at least one thread (two threads in this embodiment) has a continuous shape over the axial direction of the rotation shaft 460. Incidentally, the angles θ of the blades 46Ba, 46Bb and 46Bc may preferably be 39° or more and 80° or less, preferably be 56.5° or less.

On the other hand, the blade 46Bc as the second blade which is different from the first blade and which is provided with at least one thread (single thread in this embodiment) has a shape including a gap portion 46Bg in which the blade 46Bc is discontinuous on at least a part of the rotation shaft 460 with respect to the axial direction.

That is, a part of the blade 46Bc is removed, and this part constitutes gap portion 46Bg. The two blades 46Ba, 46Bb and 46Bc providing the two threads are formed in the named order with the same outer diameter and the same pitch with respect to the developer feeding direction of the second screw 46B.

Incidentally, the first screw for stirring and feeding the developer in the developing chamber 47 is a three-thread screw similar to the second screw 46B but is not provided with the gap portion at any of the blades. However, also the first screw may have a shape including the gap portion in at least one blade (thread) similarly as in the case of the second screw 46B. Further, the first screw may preferably be a screw which has the same outer diameter, pitch and number of threads as those of the second screw 46B, and in this case, the gap portion may be provided similarly as in the case of the second screw 46B and may also be not provided.

Further, also in the case of this embodiment, the stirring distance coefficient of the second screw 46B is 0.5 or more and 4.9 or less, preferably 2.0 or more and 3.7 or less.

Also in the case of this embodiment, for example, the screw lead was 30 mm, the screw outer diameter was 14 mm, and the diameter of the rotation shaft 460 was 6 mm. Further, the blades 46Ba and 46Bb have continuous shapes over the axial direction, and the blade 46Bc is provided with the gap portion 46Bg periodically formed over the entire region between the communication ports 43*a* and 43*b* with respect to the axial direction. Further, the ratio between the blade 46Bc and the gap portion 46Bg (areal ratio between the portion of the blade 46Bc projected in the axial direction correspondingly to one-full circumference and the gap portion 46Bg) is made 1:1.

In this constitution, similarly as in the Second Embodiment, not only the stirring property can be improved by providing the blade 46Bc with the gap portion 46Bg, but also the feeding property can be improved by the continuous shapes of the blades 46Ba and 46Bb. In addition, in this embodiment, by employing the three-thread screw, it is possible to improve the feeding performance and the stirring performance of the screw as a whole.

Incidentally, when the stirring distance coefficient of the second screw 46B satisfies the above-described range, the above-described ratio and regularity of the blade existing portion and the gap portion can be appropriately set. For example, the blade and the gap portion may be combined every arbitrary phase, and the second screw 46B may also have a shape such that the gap portion is not partly provided at a part thereof with respect to the developer feeding direction (longitudinal direction).

Specific Embodiment

Here, as an experiment in which in a constitution of the multi-thread screw, a difference in stirring performance with respect to the stirring distance coefficient was checked will be described. In the experiment, in the case where the number of threads of the second thread is two, three and four, in a constitution in which only one blade (thread) is provided with the gap portion in each of the second screws, the ratio between the blade and the gap portion (areal ratio between the gap portion-containing blade portion projected in the axial direction correspondingly to one-full circumference and the gap portion) was changed. Further, in each of the cases, the stirring distance coefficient calculated from the sum of the screw outer peripheral distances, and the peak change value Δ (%) of the toner content were checked.

Each of the screws was 30 mm in screw pitch, 14 mm in screw outer diameter and 6 mm in diameter of the rotation shaft. The blade provided with no gap portion has a continuous shape over the axial direction, and the blade provided with the gap portion was periodically formed over the entire region between the communication ports 43*a* and 43*b* with respect to the axial direction. Further, the helix angle of each of the respective screws was set at not more than a 56.5°.

An experimental condition was similar to that in the case of the First Embodiment shown in FIG. 11. An initial developer was placed in the developing container 41 as shown in FIGS. 2 and 3, and then a supplied toner was added. At that time, the peak change value Δ (%) of the toner content sensor 49 was calculated. A result thereof is shown in FIGS. 15 and 16.

Incidentally, in FIGS. 15 and 16, as regards a ratio between a region where the screw blade is provided and a region where the screw blade is not provided but the gap portion is provided, a ratio when the region of the gap portion 46Ag is taken as 1.

As apparent from FIGS. 15 and 16, it turned out that in the case of the four-thread screw, even when the stirring distance coefficient increased, the peak change value Δ (%) was not increased to a value exceeding 1, but can be made 0.5 or more. Further, as described in the Second Embodiment, it turned out that even when the ratio between the blade and the gap portion was 1:1 and 1.5:1, the peak change value can be made 0.5 or more.

On the other hand, it turned out that in the case of the three-thread screw, the peak change value Δ (%) can be made 1 or more, and even in the case of the two-thread screw, the peak change value Δ (%) can be made 1.0 or more by making the above-described ratio 2:1 or more, i.e., by making the stirring distance coefficient 2 or more.

From the above, it turned out that when the stirring distance coefficient of the second screw was 0.5 or more and 4.9 or less, the density non-uniformity of the output image was able to be suppressed to some degree. Further, it turned out that when the stirring distance coefficient of the second screw was 2 or more and 3.7 or less, the density non-uniformity of the output image was able to be preferably suppressed.

Other Embodiments

The gap portions described in the above-described embodiments may only be required to be portions where the blade is discontinuous, and for example, between the adjacent portions of the blade 46Bc with respect to a direction along a helix in FIG. 14, a blade having an outer diameter smaller than the outer diameter of the blade 46Bc may also exist. That is, a part of an outer peripheral surface of the blade continuous in the axial direction is cut away at a part of the axial direction, and this cut-away portion may also be used as the gap portion. In summary, the present invention also includes the case such that a blade-free portion where components of a flow of the developer generate along the feeding direction and the stirring direction at a part of the blade with respect to the axial direction corresponds to the gap portion, and the gap portion includes not only the case where the blade is completely removed but also the case where the blade partly remains.

In the above-described embodiments, the shape such that of the plurality of blades (threads), at least one blade (thread) is provided with the gap portion or is omitted (removed) was described. However, the present invention may also employ a constitution other than the above-described constitutions when in the constitution, a fifth blade having at least one thread is higher in developer feeding force than (another) sixth blade having at least one thread and the sixth blade is higher in developer stirring force than the fifth blade. For example, of the three blades (threads), one blade (chamber) is lower in feeding force than other two blades (threads) but is higher in stirring force than other two blades (threads) by changing an outer diameter, a pitch or a helix angle of the one blade (thread) relative to the other two blades (threads).

In the above-described embodiments, the two-thread screw or the three-thread screw were described as the screw including a plurality of blades (threads), but the present invention is also applicable to screws including four or more threads when the relationship between the volumes of the gap portion and the blade is one of the above-described relationships. As in the Fifth Embodiment, also the constitution in which the gaps between adjacent blades are different from each other is also applicable to a multiple-thread screw providing three or more threads.

In the above-described embodiments, the constitution in which the image forming apparatus was the printer was described, but the present invention is also applicable to a copying machine, a facsimile machine, a multi-function machine and the like. Further, in the above-described embodiments, as the developing device, the constitution in which the developer is supplied from the developing chamber to the developing sleeve and is collected from the developing sleeve into the developing chamber was described. However, the present invention is also applicable to a constitution in which the developer is supplied from the developing chamber (first chamber) and is collected in the stirring chamber (second chamber) provided while sandwiching the partition wall between itself and the developing chamber. Further, other than the developing device in which the first chamber and the second chamber are disposed and arranged in the horizontal direction, the present invention is applicable to constitutions such that the first chamber and the second chamber exist in a positional relationship that the first chamber and the second chamber are disposed along an up-down direction or are disposed so as to be inclined with respect to the horizontal direction.

At the sensor for detecting the toner content, the inductance sensor was used in the above-described embodiments. However, other than the inductance sensor, for example, a sensor capable of detecting the toner content in another type, such as an optical sensor may also be used as the toner content sensor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100862 filed on May 22, 2017, which is hereby incorporated by reference herein in its entirety.

What is claimed is:

1. A feeding screw for feeding a developer, comprising:

a rotation shaft; and a helical blade provided on said rotation shaft and including a plurality of threads, wherein said helical blade includes a first blade helically formed with a single thread on said rotation shaft, a second blade helically formed with a single thread on said rotation shaft, and a third blade helically formed with a single thread on said rotation shaft, wherein said first blade is continuously formed over a rotational axis direction of said feeding screw in one lead of said first blade, said second blade is continuously formed over the rotational axis direction of said feeding screw in one lead of said second blade, and said third blade includes a first portion and a second portion, the first portion of said third blade and the second portion of said third blade being discontinuous with respect to the rotational axis direction of said feeding screw in one lead of said third blade, wherein an outer diameter of said first blade is not less than 12 mm and not more than 20 mm, a first helix angle of said first blade is not less than 39° and not more than 56.5°, the first helix angle being an angle formed between a diagonal line of a rectangle and an abscissa, the rectangle with one side of a length of an outer periphery of a circle with a diameter equal to an outer diameter of said first blade on an ordinate and the other side of a length of a lead of said first blade on the abscissa, a second helix angle of said second blade is not less than 39° and not more than 56.5°, the second helix angle being an angle formed between a diagonal line of a rectangle and an abscissa, the rectangle with one side of a length of an outer periphery of a circle with a diameter equal to an outer diameter of said second blade on an ordinate and the other side of a length of a lead of said second blade on the abscissa, an outer diameter of said third blade is not less than 12 mm and not more than 20 mm, and a third helix angle of said third blade is not less than 39° and not more than 56.5°, the third helix angle being an angle formed between a diagonal line of a rectangle and an abscissa, the rectangle with one side of a length of an outer periphery of a circle with a diameter equal to an outer diameter of said third blade on an ordinate and the other side of a length of a lead of said third blade on the abscissa.

2. A feeding screw according to claim 1, wherein the first helix angle of said first blade is not less than 50°, and not more than 56.5°, the second helix angle of said second blade is not less than 50°, and not more than 56.6°, and the third helix angle of said third blade portion is not less than 50° and not more than 56.5°.

3. A feeding screw according to claim 1, wherein a gap is provided between the first portion of said third blade and the second portion of said third blade with respect to the rotational axis direction of said feeding screw, said gap is disposed within a region where said first blade is formed with respect to the rotational axis direction of said feeding screw, and said gap is disposed within a region where said second blade is formed with respect to the rotational axis direction of said feeding screw.

4. A feeding screw according to claim 1, wherein an outer diameter of said first blade is 14 mm or more and 17 mm or less, an outer diameter of said second blade is 14 mm or more and 17 mm or less, and an outer diameter of said third blade is 14 mm or more and 17 mm or less.

5. A feeding screw according to claim 1, wherein the outer diameter of said first blade is equal to the outer diameter of said second blade.

6. A feeding screw according to claim 1, wherein the outer diameter of said first blade, the outer diameter of said second blade, and the outer diameter of said third blade are equal.

7. A developing device, comprising:

a developer carrying member configured to carry a developer containing toner and a carrier in order to develop an electrostatic latent image formed on an image bearing member;

a developing container including a first chamber configured to supply the developer to said developer carrying member, a second chamber partitioned from said first chamber by a partition wall, a first communication portion configured to permit communication of the developer from said first chamber to said second chamber, and a second communication portion configured to permit communication of the developer from said second chamber to said first chamber;

a first feeding screw provided in said first chamber and configured to feed the developer in a first direction from said second communication portion to said first communication portion; and a second feeding screw provided in said second chamber and configured to feed the developer in a second direction from said first communication portion to said second communication portion, wherein said second feeding screw includes, a rotation shaft, a first blade helically formed with a single thread on said rotation shaft, a second blade helically formed with a single thread on said rotation shaft, and a third blade helically formed with a single thread on said rotation shaft, wherein said first blade is continuously formed over a rotational axis direction of said second feeding screw in one lead of said first blade, said second blade is continuously formed over the rotational axis direction of said second feeding screw in one lead of said second blade, and said third blade includes a first portion and a second portion, the first portion of said third blade and the second portion of said third blade being discontinuous with respect to the rotational axis direction of said second feeding screw in one lead of said third blade, wherein an outer diameter of said first blade is not less than 12 mm and not more than 20 mm, a first helix angle of said first blade not less than 39° and is not more than 56.5°, the first helix angle being an angle formed between a diagonal line of a rectangle and an abscissa, the rectangle with one side of a length of an outer periphery of a circle with a diameter equal to an outer diameter of said first blade on an ordinate and the other side of a length of a lead of said first blade on the abscissa, an outer diameter of said second blade is not less than 12 mm and not more than 20 mm, a second helix angle of said second blade is not less than 39° and not more than 56.5°, the second helix angle being an angle formed between a diagonal line of a rectangle and an abscissa, the rectangle with one side of a length of an outer periphery of a circle with a diameter equal to an outer diameter of said second blade on an ordinate and the other side of a length of a lead of said second blade on the abscissa, and an outer diameter of said third blade is not less than 12 mm and not more than 20 mm, and a third helix angle of said third blade is not less than 39° and not more than 56.5°, the third helix angle being an angle formed between a diagonal line of a rectangle and an abscissa, the rectangle with one side of a length of an outer periphery of a circle with a diameter equal to an outer diameter of said third blade on an ordinate and the other side of a length of a lead of said third blade on the abscissa.

8. A developing device according to claim 7, wherein the first helix angle of said first blade is not less than 50° and not more than 56.5°, the second helix angle of said second blade is not less than 50° and not more than 56.5°, and the third helix angle of said third blade is not less than 50° and not more than 56.5°.

9. A developing device according to claim 7, wherein a gap is provided between the first portion of said third blade and the second portion of said third blade with respect to the rotational axis direction of said second feeding screw, and said gap is disposed within a region where said first blade portion is formed with respect to the rotational axis direction of said second feeding screw, and said gap is disposed within a region where said second blade is formed with respect to the rotational axis direction of said second feeding screw.

10. A developing device according to claim 7, wherein an outer diameter of said first blade is 14 mm or more and 17 mm or less, an outer diameter of said second blade is 14 mm or more and 17 mm or less, and an outer diameter of said third blade is 14 mm or more and 17 mm or less.

11. A developing device according to claim 7, further comprising a toner content detecting portion provided in said second chamber and configured to detect a content of the developer in said developing container, wherein with respect to the second direction, the first portion of said third blade is provided upstream of said toner content detecting portion, and wherein with respect to the second direction, the second portion of said third blade is provided upstream of said toner content detecting portion.

12. A developing device according to claim 7, further comprising a developer supplying portion provided in said second chamber and configured to supply the developer into said developing container, wherein with respect to the second direction, the first portion of said third blade is provided downstream of said developer supplying portion, and wherein with respect to the second direction, the second portion of said third blade is provided downstream of said developer supplying portion.

13. A developing device according to claim 7, further comprising a developer supplying portion provided in said second chamber and configured to supply the developer into said developing container; and a toner content detecting portion provided in said second chamber and configured to detect a toner content of the developer in said developing container;

wherein with respect to the second direction, the first portion of said third blade is provided downstream of said developer supplying portion and upstream of said toner content detecting portion, and wherein with respect to the second direction, the second portion of said third blade is provided downstream of said developer supplying portion and upstream of said toner content detecting portion.

14. A developing device according to claim 7, wherein the outer diameter of said first blade is equal to the outer diameter of said second blade.

15. A developing device according to claim 7, wherein the outer diameter of said first blade, the outer diameter of said second blade, and the outer diameter of said third blade are equal.

* * * * *